US009173439B2

(12) United States Patent
Gray

(10) Patent No.: US 9,173,439 B2
(45) Date of Patent: Nov. 3, 2015

(54) CONVERTIBLE GARMENT

(75) Inventor: Brenda J. DePena Gray, Atlanta, GA (US)

(73) Assignee: Brenda DePena Gray, Atlanta, GA (US)

( * ) Notice: Subject to any disclaimer, the term of this patent is extended or adjusted under 35 U.S.C. 154(b) by 508 days.

(21) Appl. No.: 13/567,195

(22) Filed: Aug. 6, 2012

(65) Prior Publication Data

US 2013/0239286 A1 Sep. 19, 2013

Related U.S. Application Data

(60) Provisional application No. 61/612,684, filed on Mar. 19, 2012.

(51) Int. Cl.
*A41D 15/00* (2006.01)

(52) U.S. Cl.
CPC ..... *A41D 15/00* (2013.01)

(58) Field of Classification Search
CPC ..... A41D 15/00; A41D 15/007; A41D 23/00; A41D 2023/004; A41D 15/005; A41D 15/02; A41D 15/04; A41D 1/06; A41D 1/22; A41D 3/08
USPC ..... 2/91, 207, 88, 69, 72, 86
See application file for complete search history.

(56) References Cited

U.S. PATENT DOCUMENTS

| | | | | |
|---|---|---|---|---|
| 1,906,846 | A * | 5/1933 | Finger | 2/91 |
| 2,237,368 | A * | 4/1941 | Seitzman et al. | 2/91 |
| 2,504,534 | A * | 4/1950 | Kephart et al. | 2/114 |
| 4,706,304 | A * | 11/1987 | Jones | 2/91 |
| 5,640,715 | A * | 6/1997 | Adams | 2/46 |
| D509,343 | S * | 9/2005 | Bragg | D2/840 |
| 7,424,751 | B1 * | 9/2008 | Miller | 2/209.11 |
| D603,139 | S * | 11/2009 | Martin | D2/823 |
| 8,468,612 | B1 * | 6/2013 | Galloway | 2/207 |
| 8,549,666 | B2 * | 10/2013 | Gheneva | 2/115 |
| 2008/0047044 | A1 * | 2/2008 | Jones | 2/84 |
| 2008/0168590 | A1 * | 7/2008 | Bousquet et al. | 2/74 |
| 2010/0071110 | A1 * | 3/2010 | Stevens | 2/69 |
| 2011/0055999 | A1 * | 3/2011 | Su | 2/207 |
| 2014/0310851 | A1 * | 10/2014 | Jones | 2/129 |
| 2015/0007377 | A1 * | 1/2015 | Pavalon et al. | 2/69 |

FOREIGN PATENT DOCUMENTS

| | | | | |
|---|---|---|---|---|
| FR | 2828070 A1 * | 2/2003 | | A41D 23/00 |
| GB | 2405782 A * | 3/2005 | | A41D 15/00 |
| WO | WO 2010097820 A1 * | 9/2010 | | A41D 1/22 |

* cited by examiner

*Primary Examiner* — Amy Vanatta

(57) ABSTRACT

The present invention is unique in its design and function, it can be worn by any adult and fashioned into several types of apparel ranging from a hat and scarf to a pair of gaucho pants. Because the garment does not have buttons or snaps, it can be easily utilized by persons with handicaps or disabilities. It can be worn as a head and shoulder shawl, a hat and neck scarf, a top wear, a light jacket, a shrug, and pants. The unique design is the one cut and two sewing seams creation of the bell sleeve type garment out of a light weight stretchable fabric. There are no hooks, Velcro, zippers or buttons. For creating a tapered sleeve type garment, an additional cut is made. Because of its simplicity, the garment of the present invention is cost efficient to manufacture.

13 Claims, 47 Drawing Sheets

CONVERTIBLE GARMENT

REFERENCE TO RELATED APPLICATIONS

This patent application claims the benefit of U.S. Provisional Application No. 61/612,684 filed on Mar. 19, 2012 the disclosure of which is incorporated herein by reference in its entirety.

BACKGROUND OF THE INVENTION

1. Field of the Invention

The present invention relates to the field of clothing, and more particularly to a garment that can be worn in a variety of styles and fashions.

2. Description of Related Art

The item described herein represents a unique product because it is convertible and compact. It is cost effective and rather easy to put on, take off and wear in general. This invention has appeal for all ages and while primarily designed for use by women can also be worn by men. The varying ways in which this product can be worn lends itself to multiple uses as well as functionality. For example:

1. When worn as a head dress it has appeal to persons of both religious and non religious practices.

2. Within certain regions of the world there is uncertainty as to the weather and temperature conditions. Since this sometimes poses a problem with preparation and readiness for most people use of said device has the essential functionality to provide warmth and protection without sacrificing style, compatibility, flexibility, availability, storage and cost.

3. The travel industry has forced people to be more conscience of the items they pack and wear. Thus traveling to and from different climates bring about different needs. The hat and scarf worn in the morning may need to be converted to a light jacket or cape by the afternoon or in a cool airplane or restaurant. This invention allows for such versatility all in one garment.

The needs and uses of said garment are evident and described in detail within this patent. The invention is appealing, simple, comfortable, convertible, light weight, cost-efficient to manufacture, and provides warmth, style, as well as affordable fashion for any person regardless of their location in the world.

SUMMARY OF THE INVENTION

It is an object of the present invention to provide a garment which is appealing, comfortable, simple, cost efficient to manufacture.

A further object of the present invention is to provide a garment which can be worn as top wear, pants, a shawl, a shrug, a scarf, a turban, a body wrap, etc.

The present invention is unique in its design and function, it can be worn by any adult and fashioned into several types of apparel ranging from a hat and scarf to a pair of gaucho pants. Because the garment does not have buttons or snaps, it can be easily utilized by persons with handicaps or disabilities. It can be worn as a head and shoulder shawl, a hat and neck scarf, a top wear, a light jacket, a shrug, and pants. It can be worn underneath or over a coat, or with or without other garments.

Another unique feature is that it can be used by men all over the world as either head turban and/or shoulder cover.

The garment according to the present invention comprises a shawl or panel portion, two sleeves/tube portions, and a body portion between the two tube portions. The garment can be made with either wide bell (or straight) shaped sleeves or tapered sleeves, which does not change the function ability of the garment.

The unique design is created using one cut and a two sewn seam pattern which is used in the creation of a bell sleeve type garment out of a light weight stretchable fabric. There are no hooks, Velcro, zippers or buttons needed in the creation of this device. For creating a tapered sleeve type garment, an additional cut is necessary. All this leads to a cost efficient model for manufacture.

The dimensional and construction features described in this application are cited as examples only for illustrative purposes and are not to be considered as limiting the scope of this invention. Fabrics that can be used includes but is not limited to the following:

stretch polyester fleece, jersey knit, or any combination of directional stretch fabrics.

This invention will take a variety of shapes and forms while remaining within the scope of coverage.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

Figure 1:
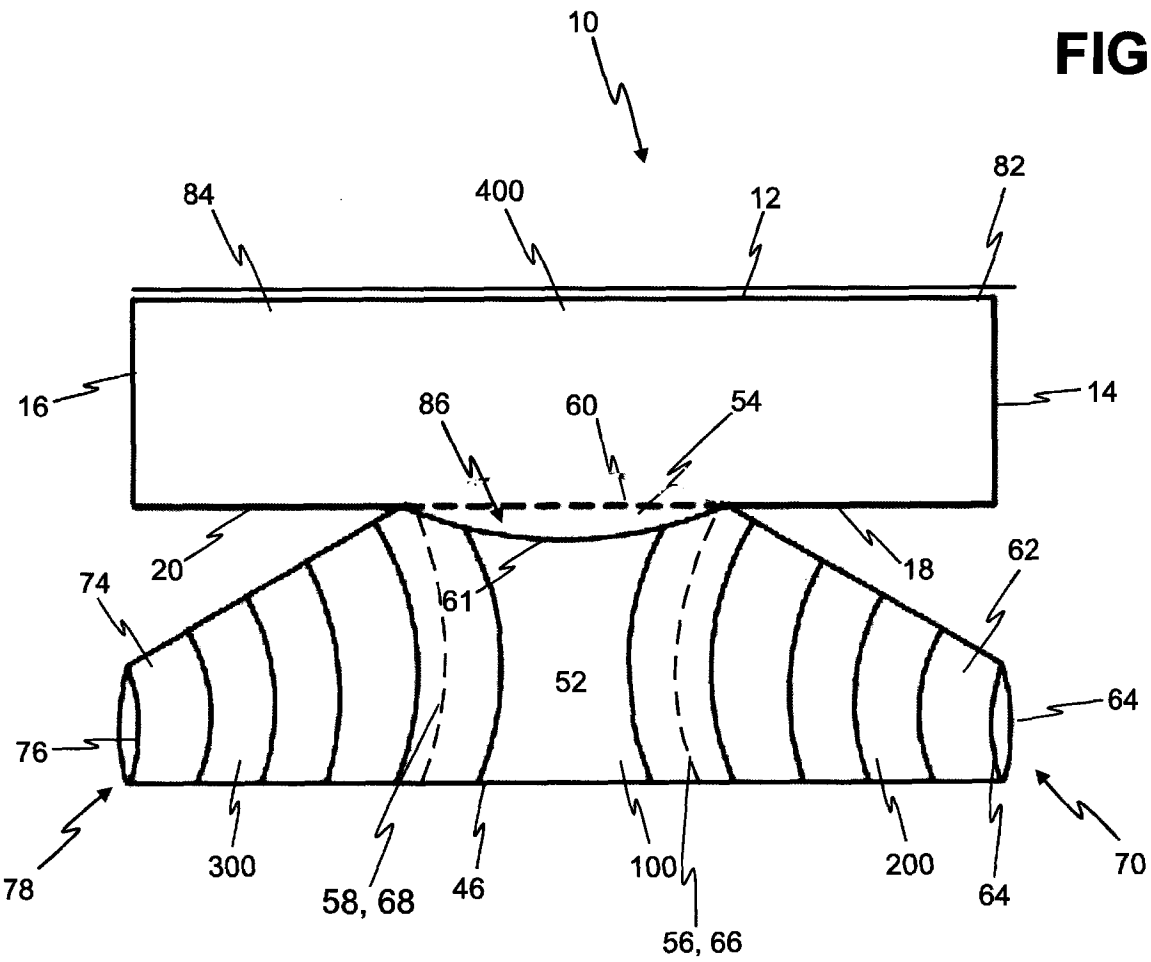
FIG. 1 is a plan view of said invention described hereinafter wherein a long flat panel is connected to a tubular triangular shaped bottom section.

Referring to FIG. 1, the overall shape of said invention can be seen. The device consists of a top portion 400 which is comprised of a flat rectangular shaped cloth. Said 400 rectangular shaped cloth is attached to a lower portion tubular and somewhat rectangular shaped cloth structure 100. At the point of attachment 60 there is an opening 86. There are also openings at the lower left and lower right of the triangular structure point 62 and point 76. It is the combination of both this flat section along with the tube like section that lends itself to being used in a vast majority of ways by an individual looking to wear the garment.

In still referring to FIG. 1, there is disclosed a convertible garment according to the first embodiment 10 of the present invention of which the tubes are in tapered shape.

The convertible garment 10 comprises a body portion 100 having an inner layer 52 and an overlapping exterior layer 54 of fabric of an equal size, both said layers having a first 56, 66 and second 58, 68 vertical edges, a first 46 and second 61, 60 horizontal edges, both said layers 52, 54 are only connected on the first horizontal edge 46, and not connected on the second horizontal edges 61, 60, leaving an opening 86 for a person to extend his/her hands/legs through.

The convertible garment 10 further comprises a first tube portion 200 having a first layer 62 and an overlapping second layer 64 of fabric of an equal size, the first layer 62 is connected to and perpendicularly extending from the first vertical edge 56 of the inner layer 52 of the body portion 100, the second layer 64 is connected to and perpendicularly extending from the first vertical edge 66 of the exterior layer 54 of the body portion 100, both said layers 62, 64 of the first tube portion 200 are connected together to form a tube shape with an opening on the distal end 70; and a second tube portion 300 having a first layer 74 and an overlapping second layer 76 of fabric of an equal size, the first layer 74 is connected to and perpendicularly extending from the second vertical edge 58 of the inner layer 52 of the body portion 100, the second layer 76 is connected to and perpendicularly extending from the second vertical edge 68 of the exterior layer 54 of the body portion 100, both said layers 74, 76 of the second tube portion 300 are connected together to form a tube shape with an opening on the distal end 78. The opening 86 between the two tube portions 300, 200 allows a person to extend his/her hands/legs into tube portions 300, 200 and exit out of the openings 70, 78, respectively.

The garment 10 further comprises a panel portion 400 which has one layer of fabric. The panel portion 400 is generally rectangular in shape having two vertical edges 14, 16, a first horizontal edge of which only the middle is connected to the second horizontal edge 60 of the exterior layer 54 of the body portion 100, and a second horizontal edge 12 which is not connected to any other portion of the garment 10, thus the two ends of the panel portion 400 hang freely like flaps 82, 84.

The connections between the panel portion 400 and body portion 100, the connection between the two layers of body portion 100, and the connection between the body portion 100 and the tube portions 200, 300 may be integrally connected or sewn or seamed together. If the garment 10 is made out of one sheet of fabric, these components are integrally connected; they are parts of the fabric. The method of making the garment 10 out of one sheet of fabric will be discussed later.

The body portion 400 and the tube 100 are sizably dimensioned to allow a person to wear the garment 10 on the upper body with the two tube openings 76, 62 being worn as arm sleeves and on the lower body with the two tube openings 76, 62 being worn as pants legs. A person may extend his/her hands or legs through opening 86 into the sleeves/pants' legs 200, 300 and beyond the openings 70, 78.

In other embodiment, the tube sections 200, 300 may be in different shapes including but not limited to a straight shape, and wide bell shape which does not change the function ability of the garment.

The garment 10 may be made out of one sheet of generally rectangular light weight directional stretchable fabric having an inner surface, an outer surface, two horizontal edges, and two vertical edges. The sheet of fabric may include stretch polyester fleece, jersey knit, polyester/cotton, and any combinations thereof. The sheet of fabric is dimensioned such that the dimension measured between the two vertical edges is greater than the dimension measured between the two horizontal edges. The sheet of fabric is stretchable between two vertical edges and not stretchable between its horizontal edges.

Figure 2A:
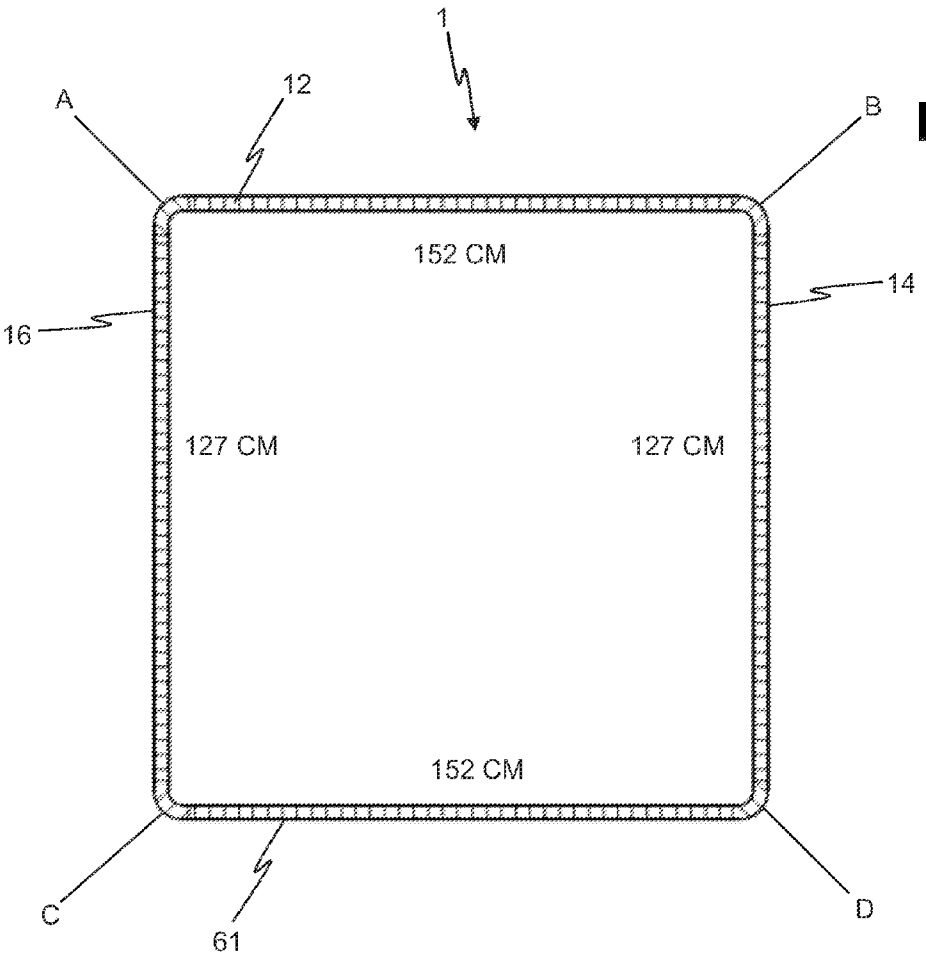
FIG. 2A is a plan view of a sheet of fabric 152 cm×127 cm which is used to make the convertible garment of the present invention.

A method of making the convertible garment with wide bell or straight shaped sleeves/tubes according to the present invention comprises the following steps:

First, obtaining one sheet of rectangular shaped fabric 1 having a first 12 and second 61 horizontal edge with a dimension L, and a first 16 and second 14 vertical edge with a dimension W, referring to FIG. 2A for a plan view of such a sheet of fabric. For easy comprehension, the four corners of the fabric are designated as A, B, C, and D, respectively. The preferred dimensions for the sheet of fabric 1 are about 60 inches (L) by 50 inches (W). The fabric 1 is stretchable between the two vertical edges 16, 14 but is not stretchable between the two horizontal edges 12, 61.

Figure 2B:
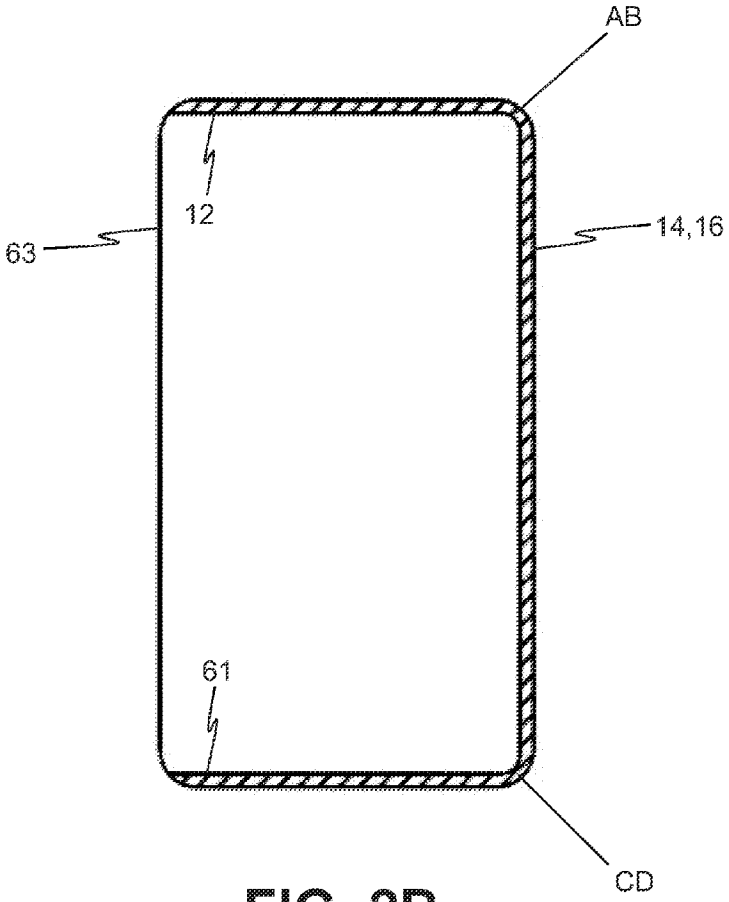
FIG. 2B illustrates that the fabric is folded in half along the vertical axis.

Secondly, fold the fabric 1 in half parallel to the vertical edge 14 creating a sheet of two layered rectangular shaped fabric with a dimension of a half of L in a horizontal direction and a dimension of W in a vertical direction. FIG. 2B illustrates fabric folded in half creating a folded line 63, wherein corners A and B are overlapped and corners C and D are overlapped.

Figure 2C:
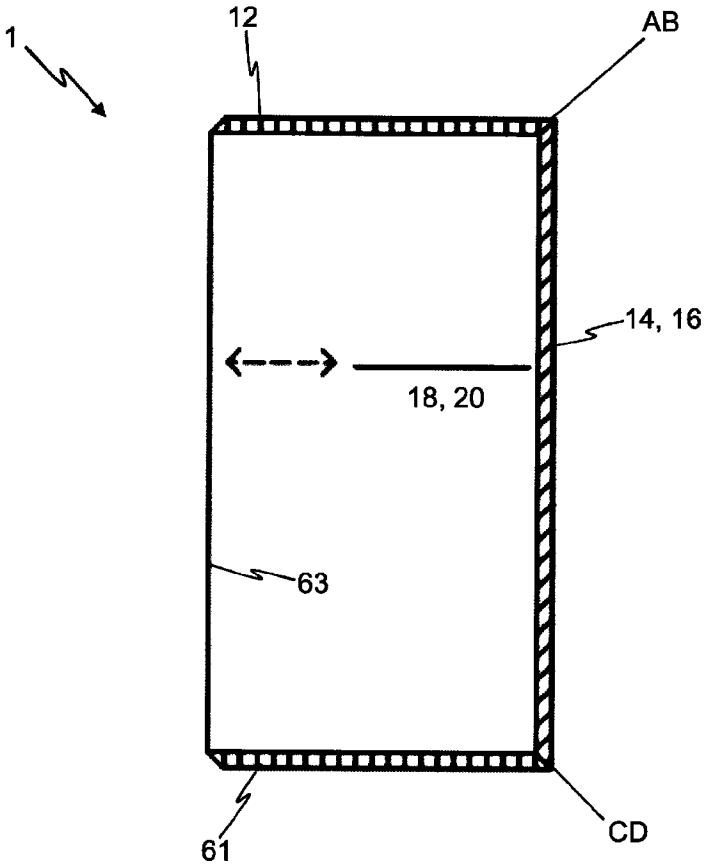
FIG. 2C is a plan view of the folded fabric having a first cutline.

Thirdly, FIG. 2C, make a first cutline at about three tenths of the dimension away from the first horizontal edge 12 in a horizontal direction starting from the overlapping vertical edges 14, 16 towards the vertical fold line 63, the first cutline is about one third of the dimension. FIG. 2C illustrates the folded fabric has a first cutline 18, 20.

Figure 3:
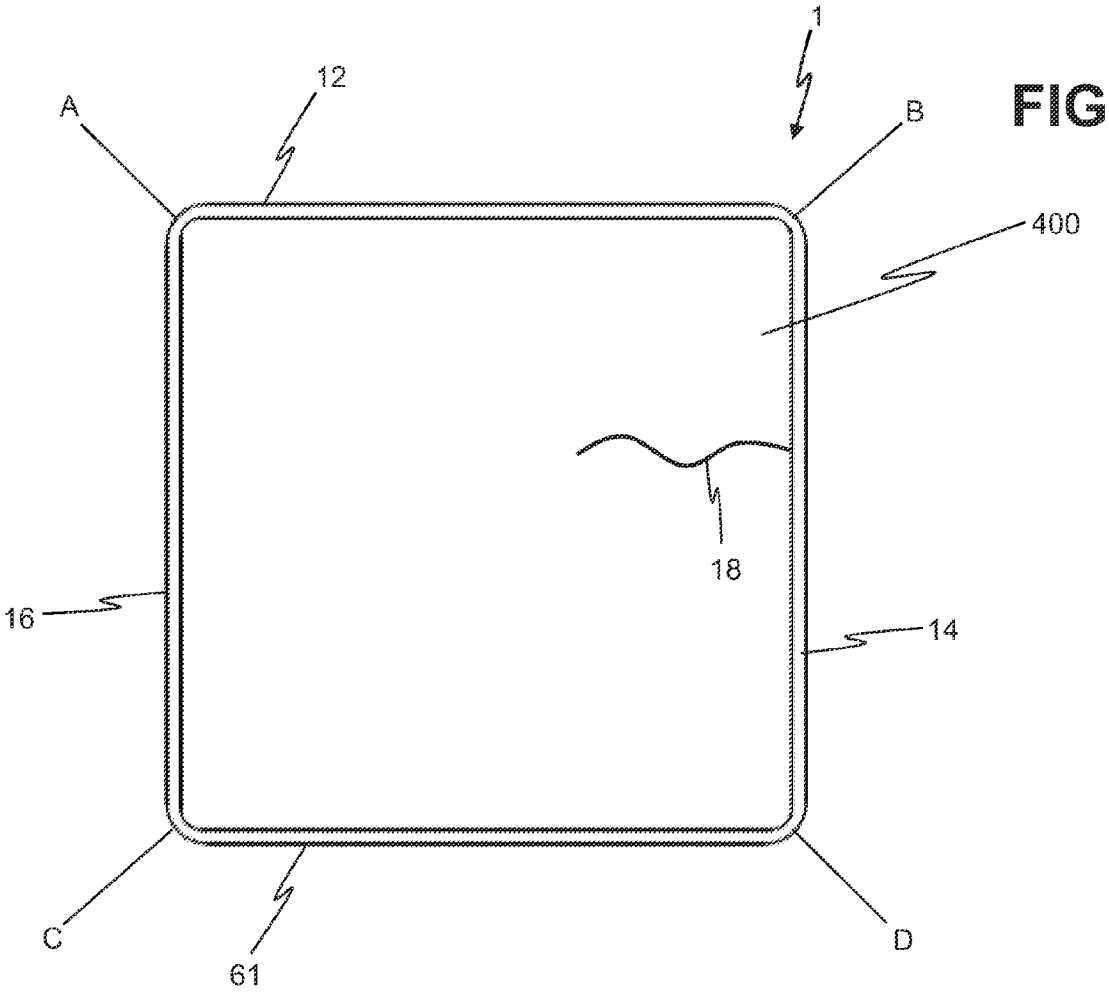
FIG. 3 is a plan view of the unfolded fabric having two first cut lines.

Next, referring to FIG. 3, unfolding the sheet of fabric 1 which has two first cut lines 18, 20, each located around three tenth of the dimension from the first horizontal edge 12 extending from the vertical edge 16, 14 towards center of the sheet of fabric 1. Each cut line 18, 20 is about one third of the dimension of the length of the sheet 1. FIG. 3 illustrates the pattern for the bell (or straight or wide) shaped tube/sleeve type garment before sewing the device together. Once the two cuts are made, the panel portion 400 which is on the top portion above the first cut lines 18, 20 in this figure is completed. This is the same top portion that can be seen in FIG. 1 on the completed embodiment of the invention.

Figure 4:
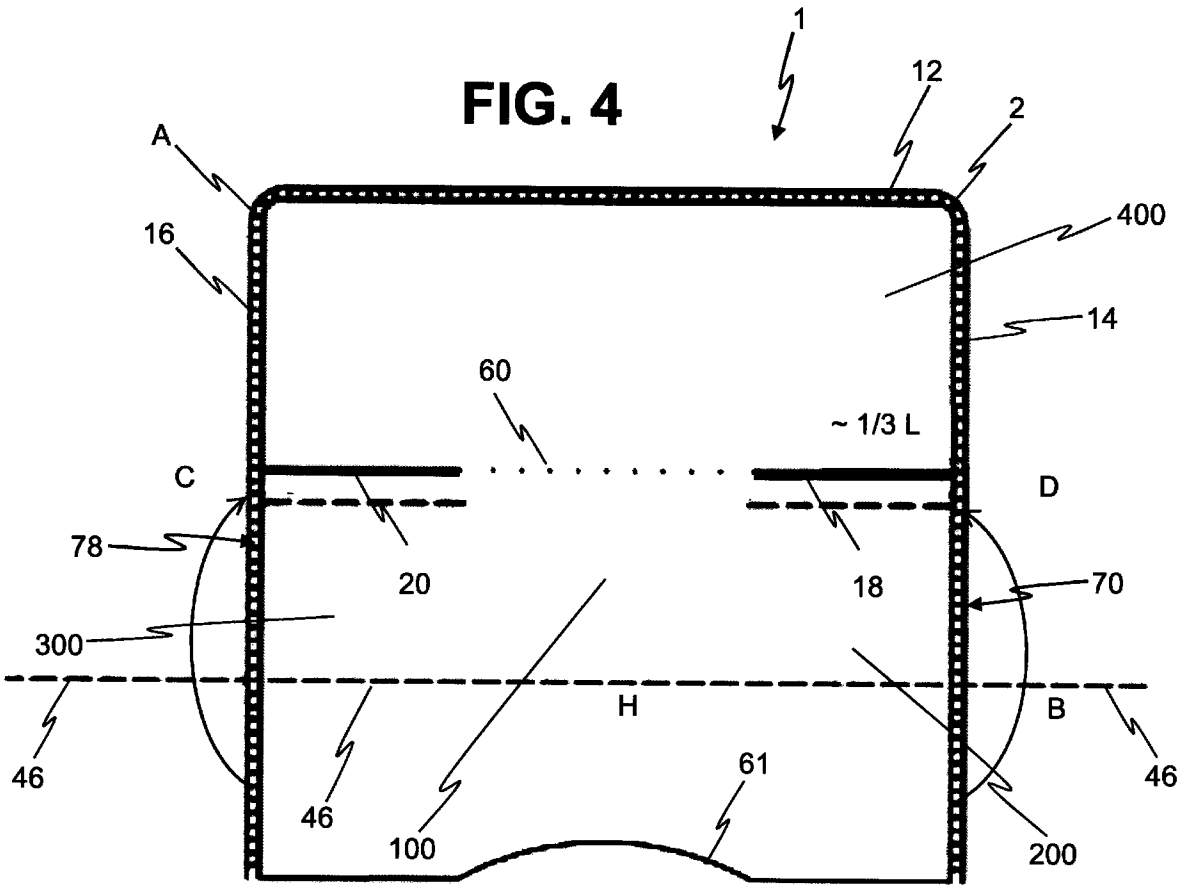
FIG. 4 is a plan view of the fabric with the second horizontal edge brought up to the first cut lines and sewn to the first cut lines, creating the pattern for the garment with wide bell shaped (or straight) sleeves.

Continuing with the development of the device refer to FIG. 4. Therein, bring up the second horizontal edge 61 to the two first cut lines 20, 18, creating a fold line 46. Stitch (Sew) together part of the second horizontal edge 61 to each of the first cut lines 20, 18 respectively to create two straight (or wide bell) shaped tubes 300, 200 with two openings on the terminal ends 78, 70, respectively which can be worn as arm sleeves or pants' legs. FIG. 4 illustrates the garment for the bell (or straight or wide) shaped tube/sleeve type garment.

The stitching (sewing) seam for creating the tube/sleeve portions are indicated in dashed line within FIG. 4. The region between the two tube portion openings 70,78 is designated as a hollow body portion 100 which has two layers of fabric and has an opening 86 for a person to extend his/her hands/legs through and into the tube body portion 100 and out the left and right side openings 70, 78.

In a preferred embodiment, the sheet of fabric 1 is about 60 inches (L) by 50 inches (W); each of the tube sections 200, 300 is about 19 inches by 17.5 inches; the panel portion 400 is about 60 inches by 15 inches; the body portion 100 is about 22 inches by 17.5 inches.

For creating a tapered sleeve type garment 10, an additional cut is necessary. A method of making the convertible garment 10 with tapered shaped sleeves/tubes according to the present invention comprises following the first three steps of the method of making a wide bell or straight shaped sleeves/tubes garment. Refer to the foregoing paragraphs and FIGS. 2A, 2B, 2C for the first three steps of making a garment with tapered shaped sleeve/tubes garment.

Figure 5:
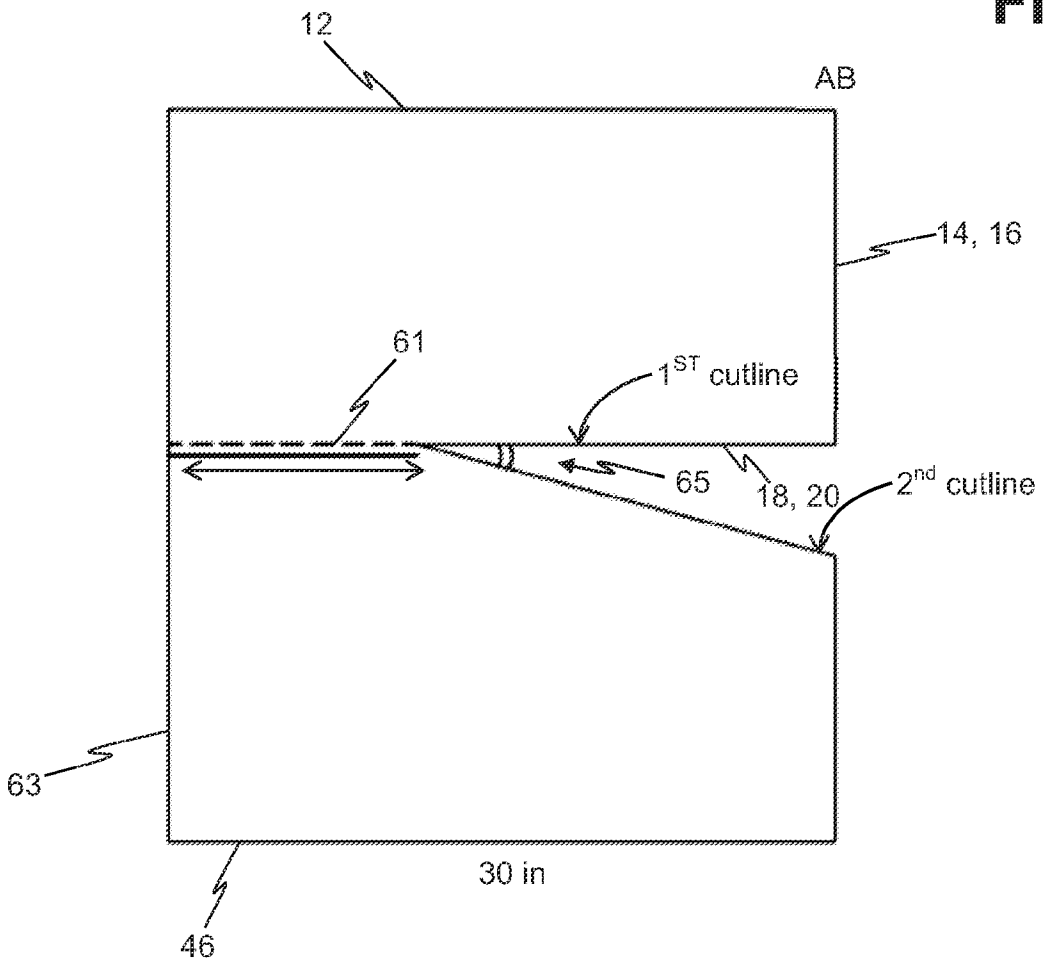
FIG. 5 is a plan view of the folded fabric with the first cutline and the second cutline for making a garment with tapered sleeves.

Next referring to FIG. 5, the second horizontal edge 61 of the fabric 1 is brought to the first cut line 20, 18, creating a fold line 46. Thereafter a second cutline is created—the second cutline starting from the vertical edges 14, 16 towards the vertical fold line 63 and forming an acute angle 65 with the first cutline 18, 20. Said FIG. 5 illustrates this second cut on the folded fabric performed to create a tapered tube or tapered sleeve effect. The preferred angle 65 between the first and second cut lines is between 25 to 45 degrees.

Figure 6:
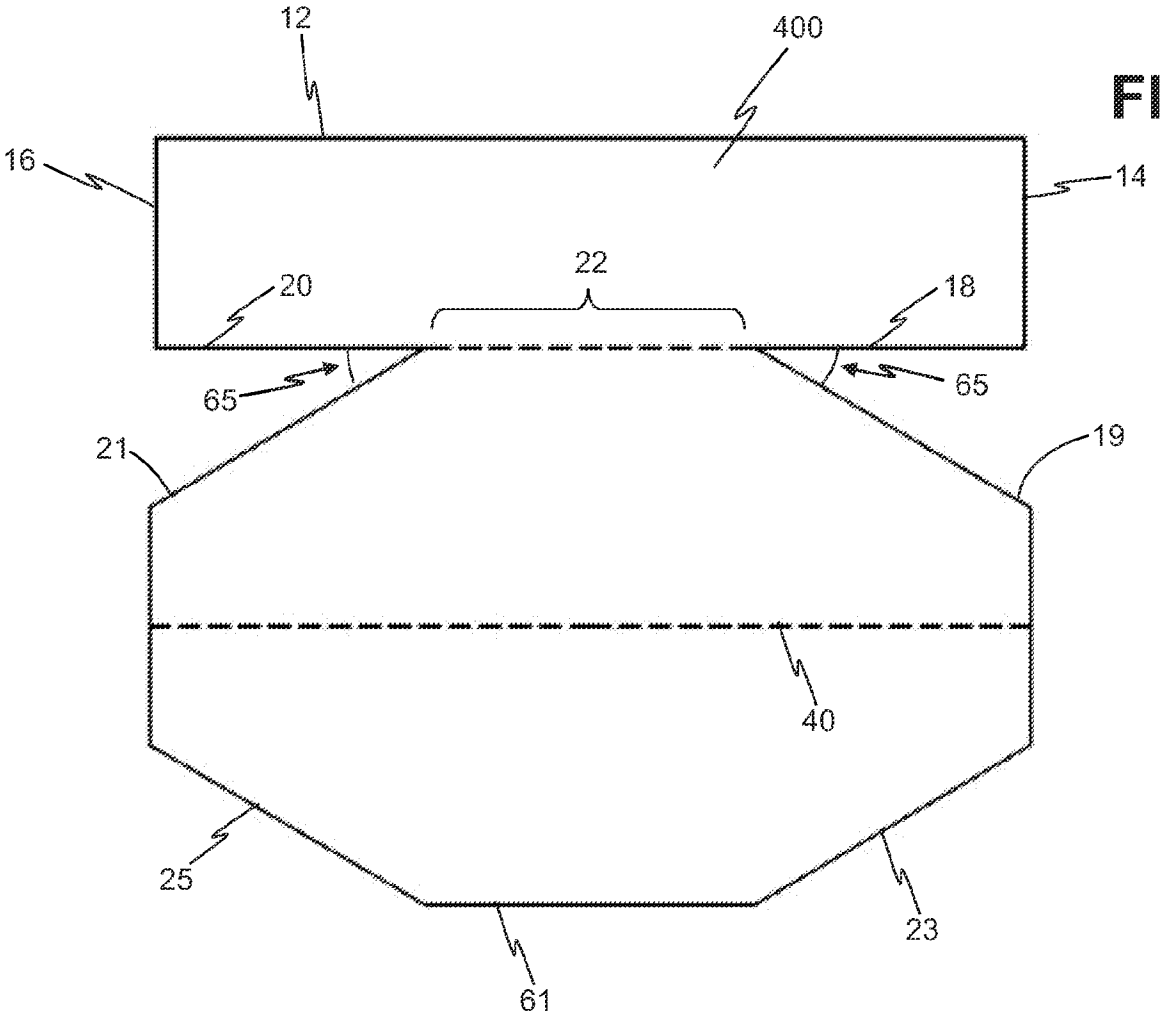
FIG. 6 is a plan view of the unfolded fabric with the two first cut lines and two second cut lines for making a garment with tapered sleeves.

After this cutting process depicted in FIG. 5, to continue creating the garment, FIG. 6, one needs to unfold the sheet of fabric 1.

FIG. 6 illustrates the fabric 1 unfolded and prepared for stitching or sewing. The fabric 1 has two first cut lines 20, 18 and four second cut lines wherein two of the second cut lines 21, 19 are connected to the two first cut lines 20, 18 respectively, and the other two of the second cut lines 25, 23 are connected to the shortened second horizontal edge 61. The portion above the first cut lines 20, 18 is designated as panel portion 400.

Subsequently, and referring to FIG. 7, the second horizontal edge 61 has been brought upward to align with the two first cut lines 20, 18; thereafter this section has been stitched or sew whereby the overlapped second cut lines 21 and 25 come together. Additionally the process of stitching or sewing the overlapped second cut lines 19 and 23 is also done to create two tapered shaped tube like portions 300, 200 with openings on the distal ends 78, 70 respectively, which can be worn as arm sleeves or pants' legs. The region between the two tube portions 300 and 200 as indicated is designated as body portion 100 which has been created by overlapping two layers of fabric. Said tube section has an opening 86 for a person to extend his/her hands/legs into the tube like structure 300, 200.

Figure 7:
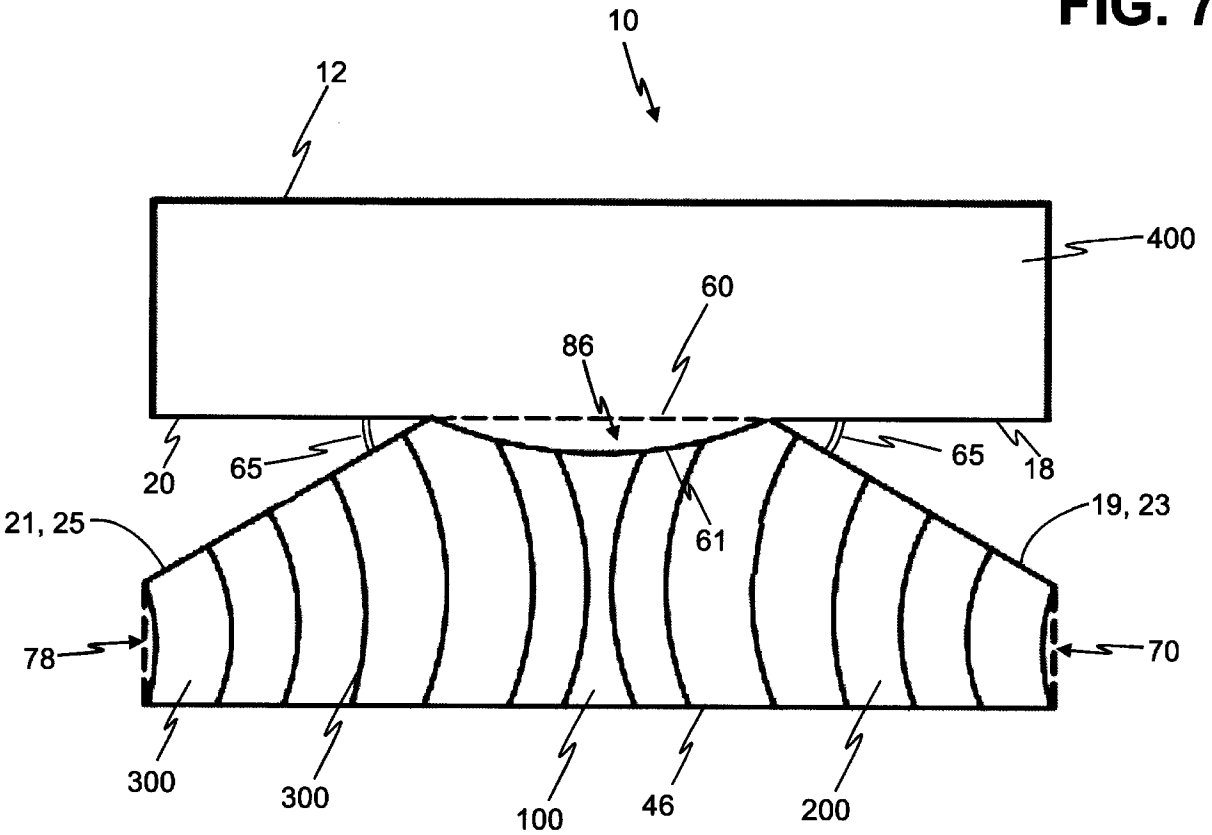
FIG. 7 is a plan view of the garment with tapered sleeves wherein the second horizontal edge of the fabric is sewn to the two second cut lines respectively to create tapered sleeves/tubes.

FIG. 7 further illustrates the garment with tapered tubes/sleeves. The stitched or sew seams have created the two tube like sections 300, 200.

In a preferred embodiment, the sheet of fabric 1 is about 60 inches (L) by 50 inches (W); each of the tubes 200, 300 is about 19 inches by 17.5 inches, the tapered sides of the tubes 21, 25, 19, 23 may be about 22 inch, the angle 65 between the first cutline and second cutline is about 30 degrees; the panel portion 400 is about 60 inches by 15 inches; the body portion 100 is about 22 inches by 17.5 inches.

The present invention is unique in its design and function, it can be worn by any adult and fashioned into several types of apparel ranging from a hat and scarf to a pair of gaucho pants. Versatility of the product can provide various functionalities.

When the garment 10 is worn on the upper body the garment can be worn in a variety of styles/fashions. The garment can be inverted and worn in a way that the panel portion 400 is on the top of the garment 10 and the body portion 100 is on the bottom of the garment 10. With the body portion 100 being worn on one's back, the two tubes 200, 300 being worn as arm sleeves, the panel portion 400 being up around ones neckline and worn as a shawl, scarf, cowl neck collar, head covering or wrap, there are many styles/fashions that can be created as shown in FIGS. 8A-11D. In these styles/fashions, the garment opens towards the front.

Figure 8A:
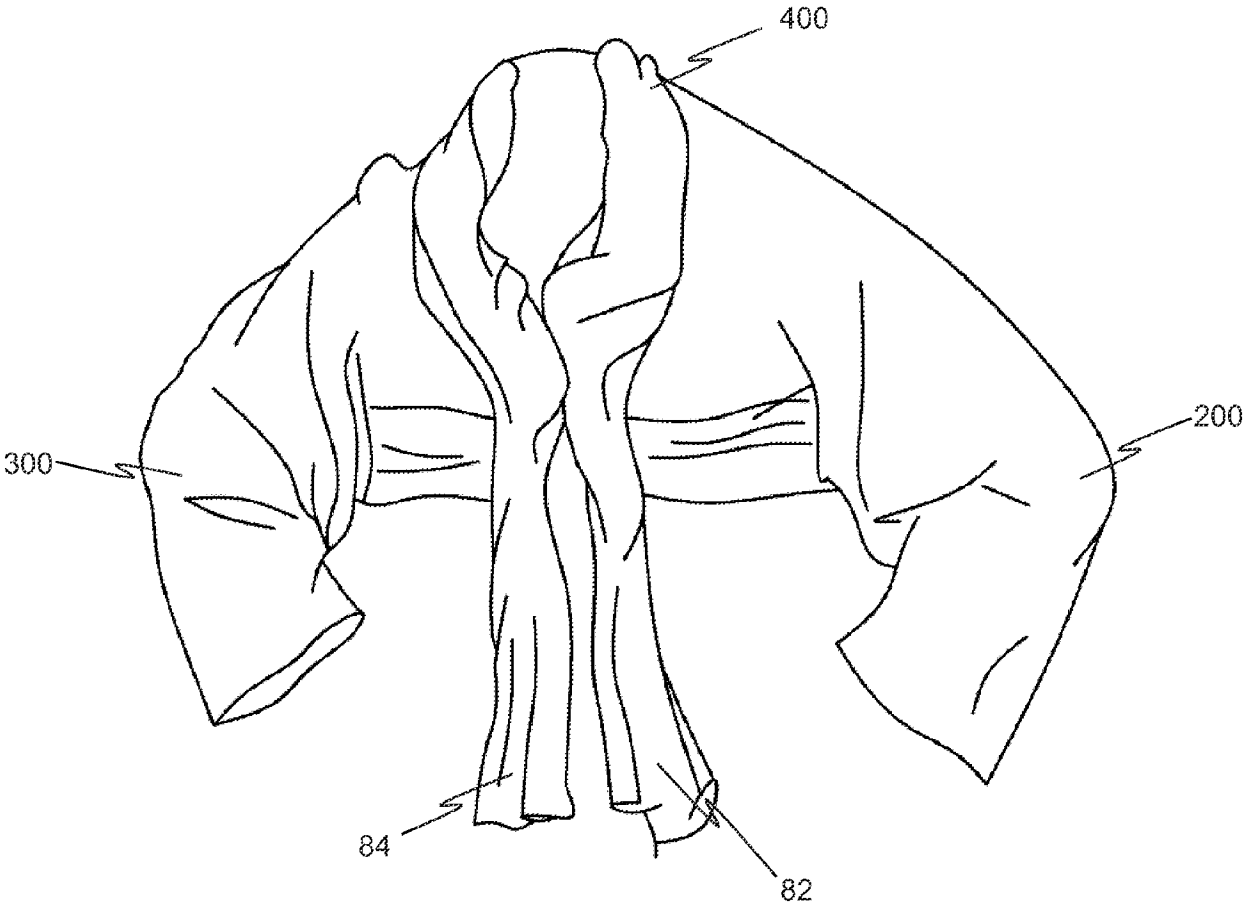
FIG. 8A is a front view of another embodiment of the convertible garment worn as a top wear wherein the garment opens toward the front and the panel is around the neck line and used as a shawl or scarf to drape in front.

FIG. 8A illustrates an embodiment of the present invention. The garment opens towards the front; the body portion 100 is on one's back, arms are placed into tube portions 200, 300, and the panel portion 400 is up at neck line and is used as the shawl or scarf portion to drape in front.

Figure 8B:
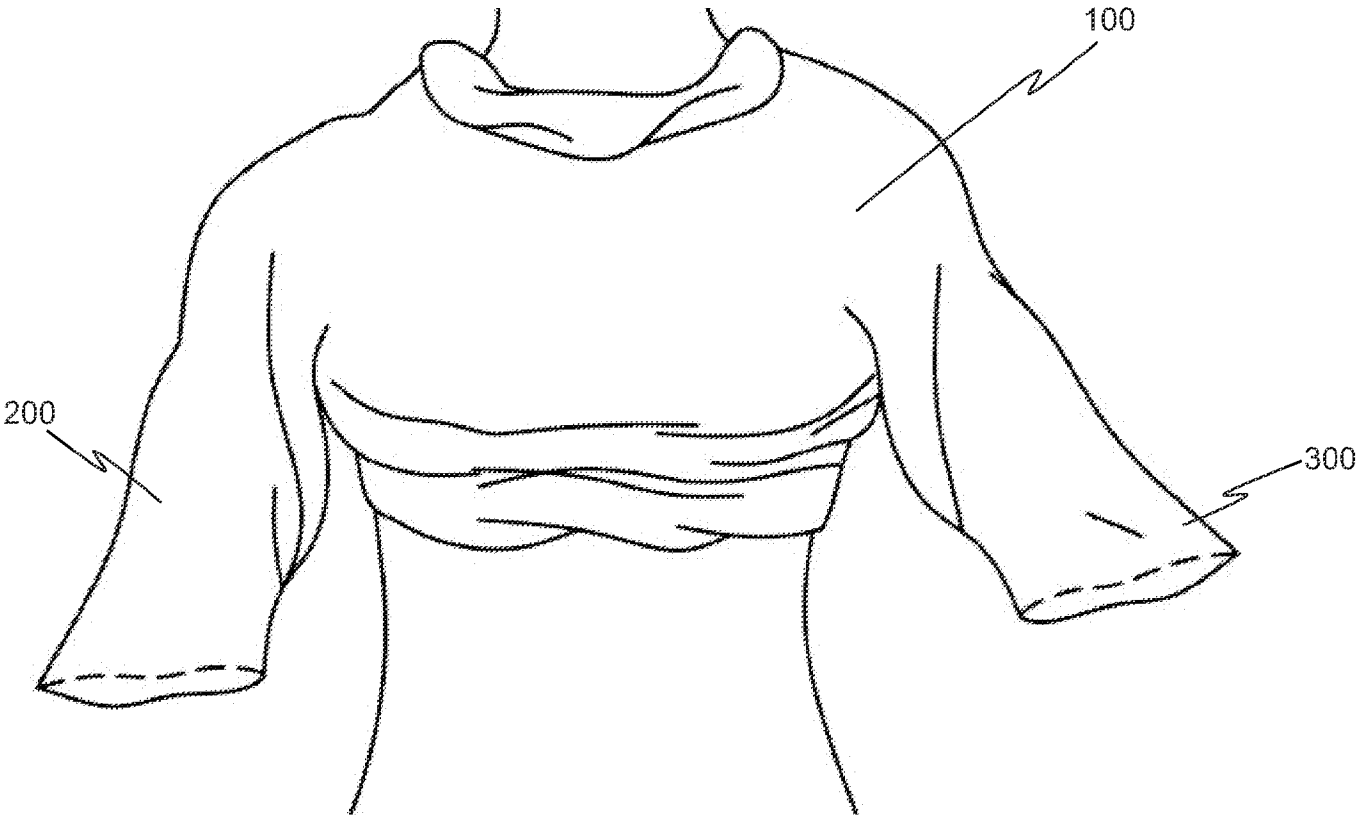
FIG. 8B is a rear view of the embodiment in FIG. 8A.

FIG. 8B illustrates the back view of FIG. 8A embodiment.

Figure 8C:
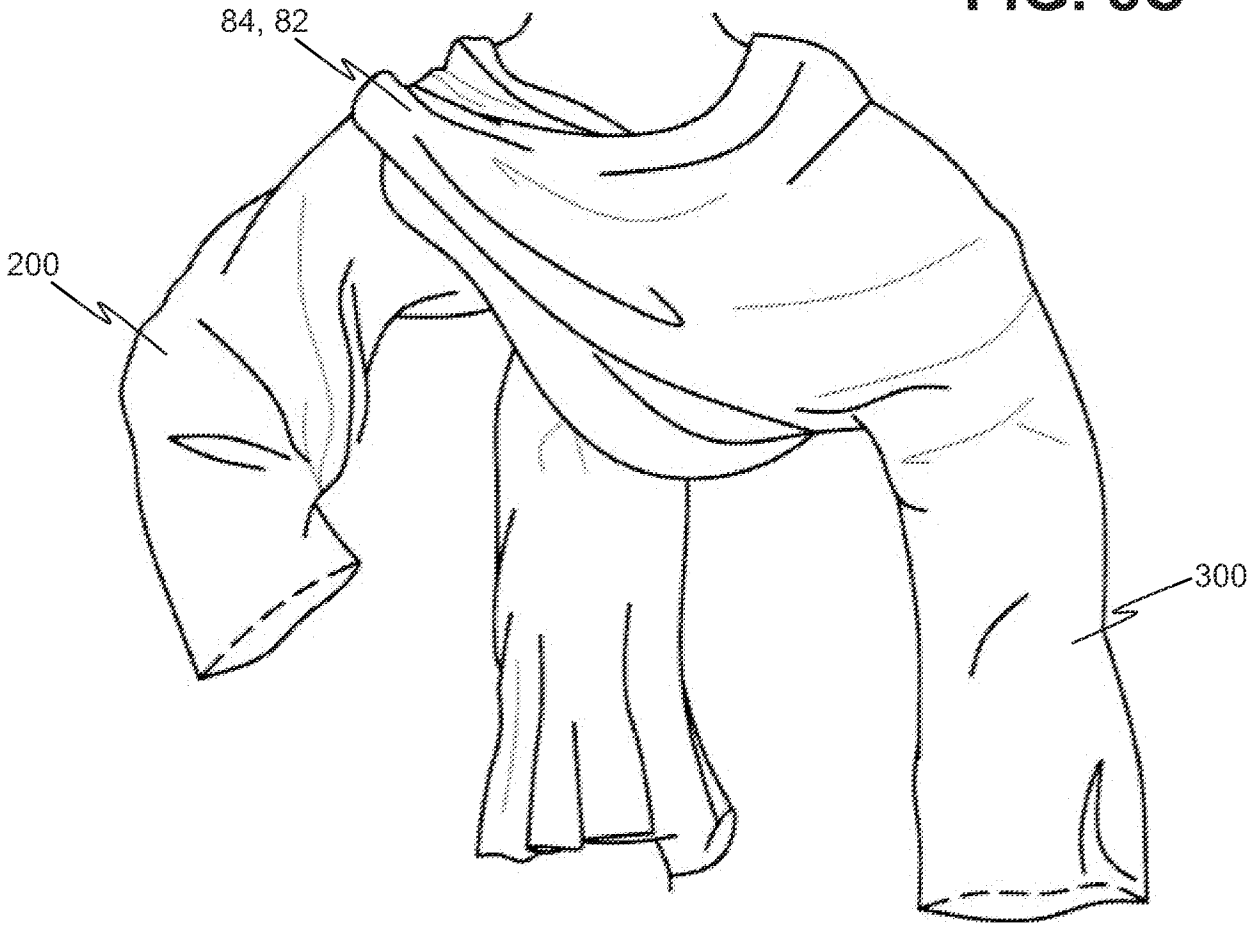
FIG. 8C is a front view of another embodiment of the convertible garment worn as a top wear wherein the garment opens toward the front and the panel is around the neck line and a portion of the panel is tossed over one shoulder.

FIG. 8C illustrates an additional embodiment where the garment opens towards the front; tubes 200, 300 are worn as arm sleeves and one flap 82 or 84 at neck line is tossed over one shoulder.

Figure 8D:
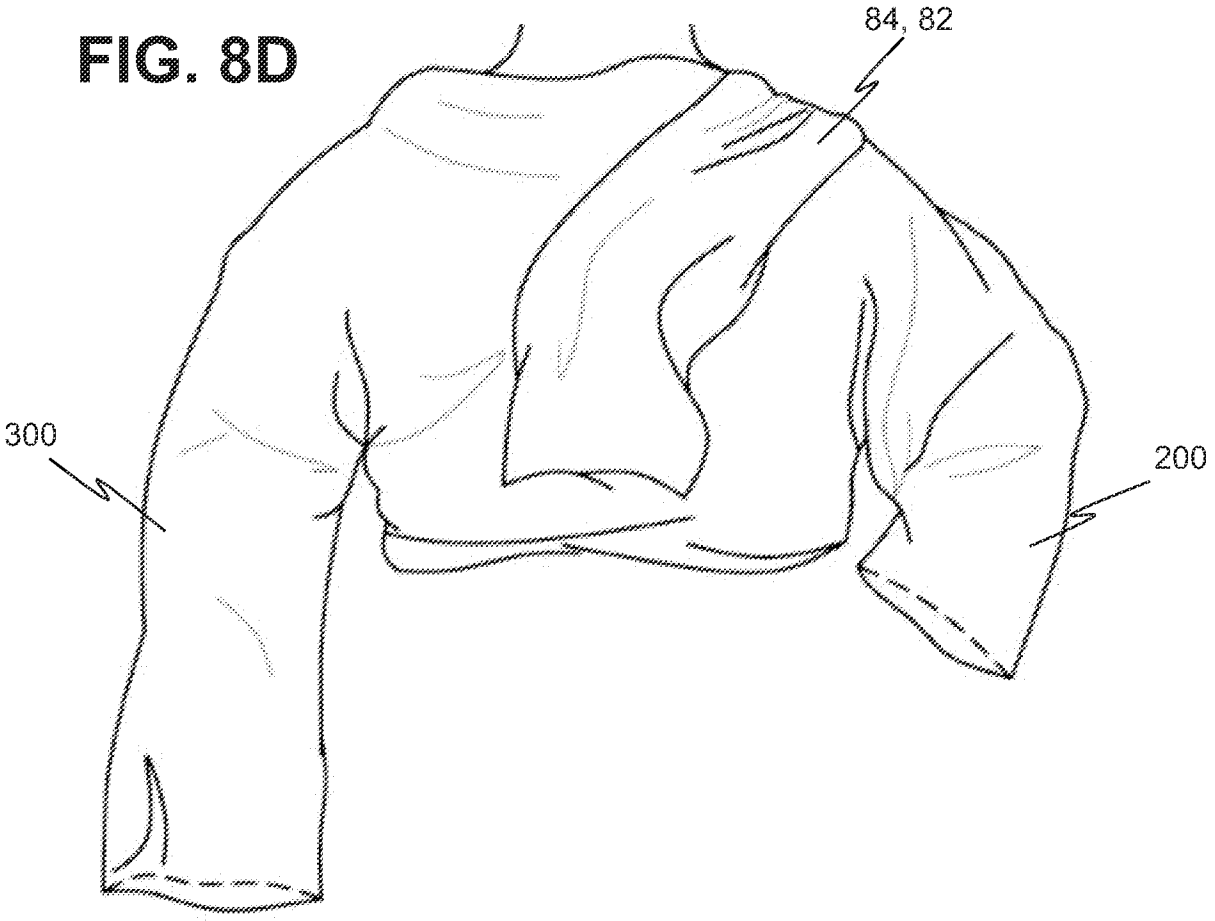
FIG. 8D is a rear view of the embodiment in FIG. 8C.

FIG. 8D illustrates the back view of the aforementioned embodiment.

Figure 9A:
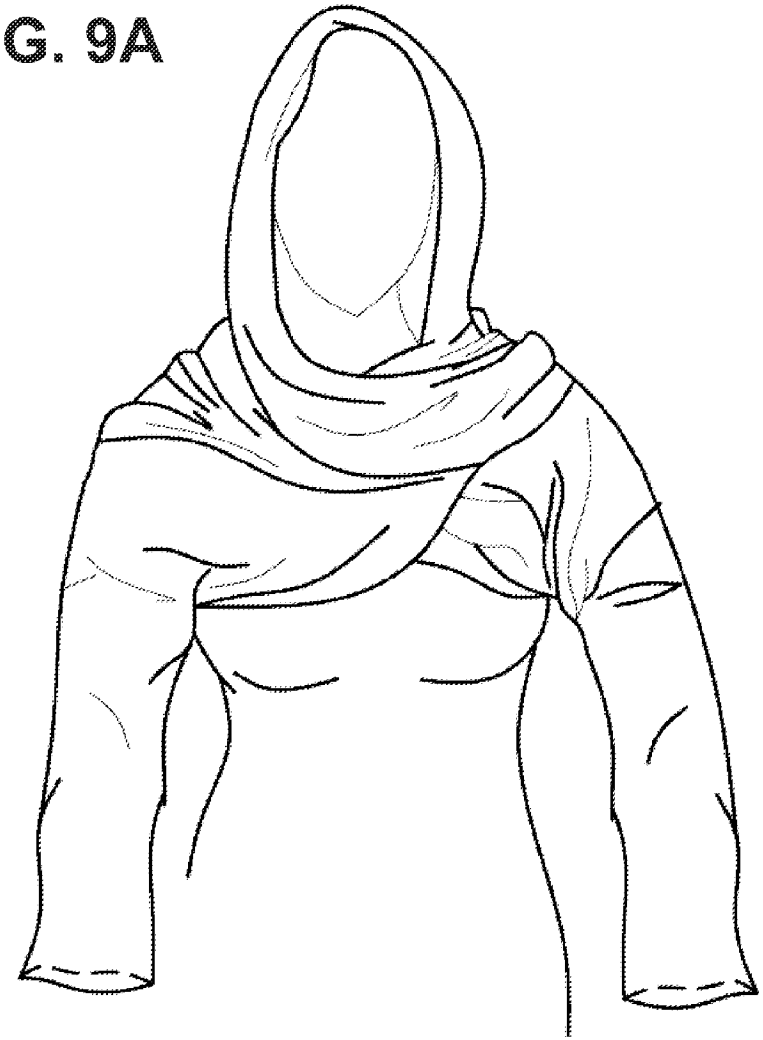
FIG. 9A is a front view of another embodiment of the convertible garment worn as a top wear and head covering wherein the garment opens toward the front and the panel is around the neck line and used as a head covering.

FIG. 9A illustrates an additional embodiment of the present invention where the garment opens toward the front; the panel portion is at the neck line and is used as a head covering, placed loosely around the head and tossed over each shoulder. The body portion and tube portions are used as sleeves, shoulders and back of the garment.

Figure 9B:
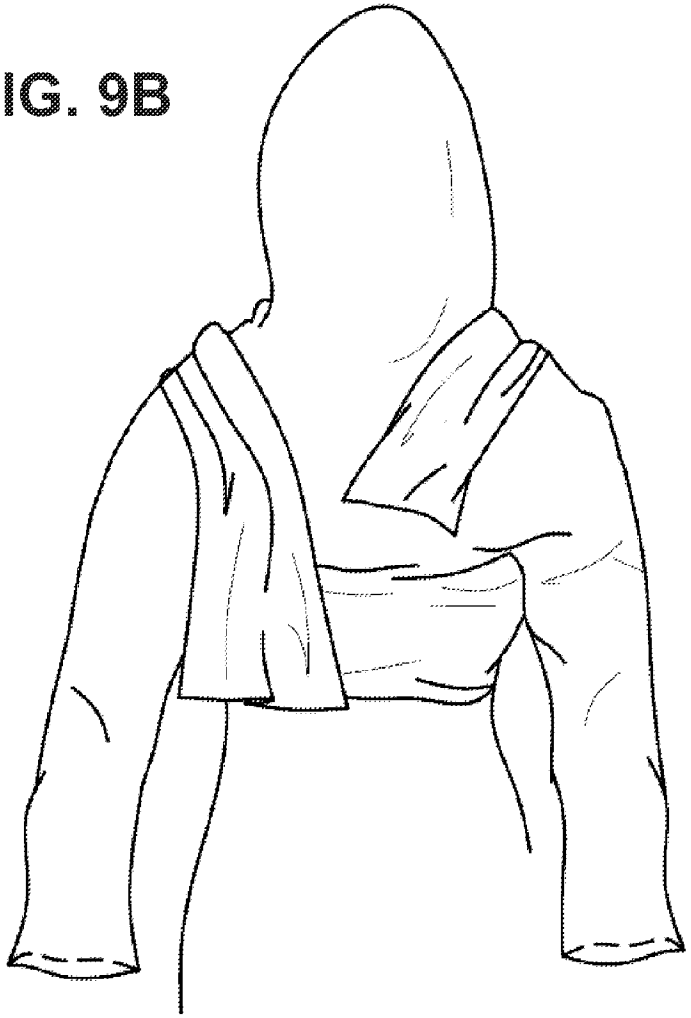
FIG. 9B is a rear view of the embodiment in FIG. 9A.

FIG. 9B illustrates the back view of said embodiment.

Figure 9C:
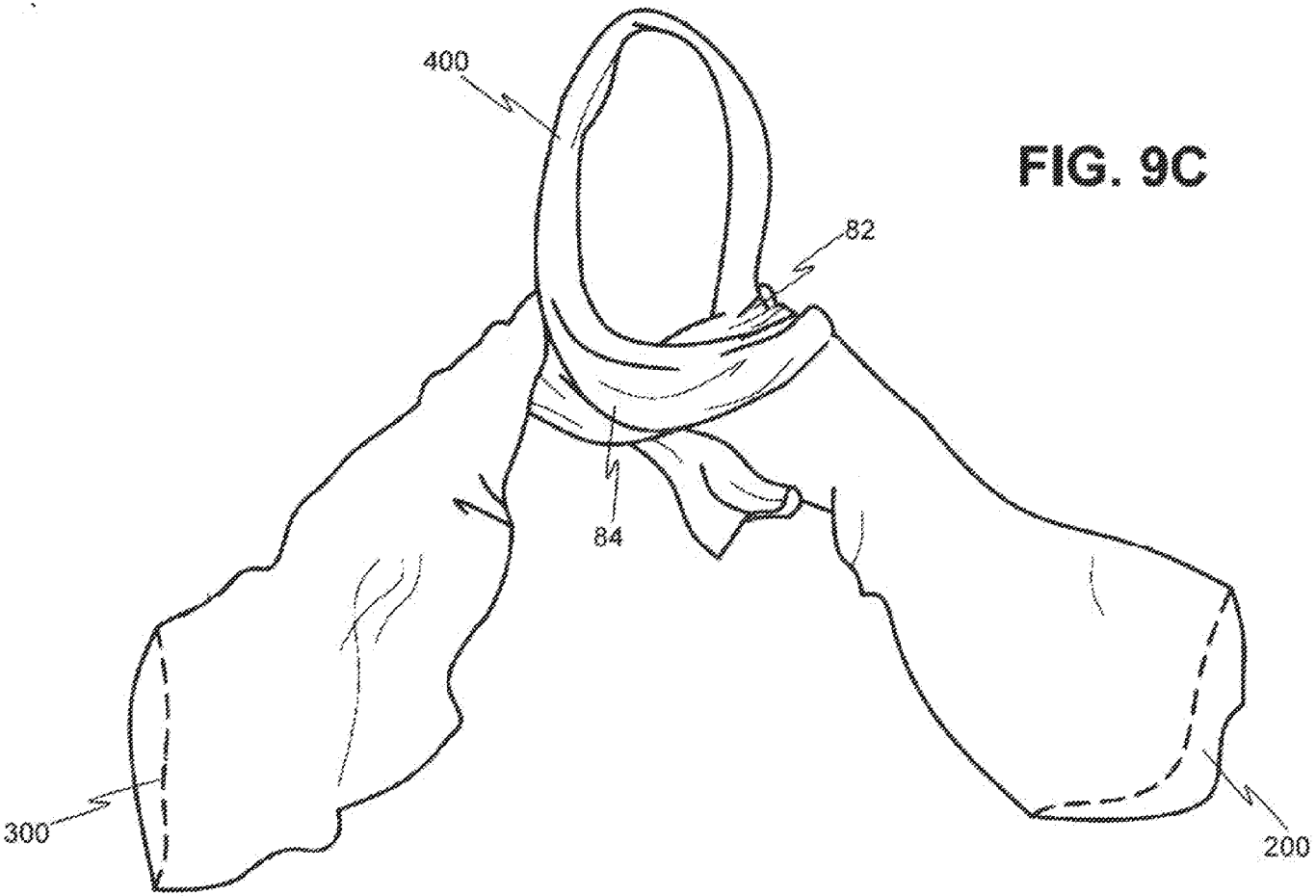
FIG. 9C is a front view of another embodiment of the convertible garment worn as a top wear and hooded wrap wherein the garment opens toward the front and the panel is around the neck line and used as a hooded wrap.

FIG. 9C illustrates an additional embodiment where the garment opens to the front; arms are placed into the tube portions 200, 300 and the panel portion 400 is at the neck line and is wrapped loosely around the head and face, tied into a knot and tucked under in the front. Alternatively, flaps 82, 84 of the panels 400 can also be brought around to the back and tied. This feature is important for women that utilize head covering as part of daily life.

Figure 9D:
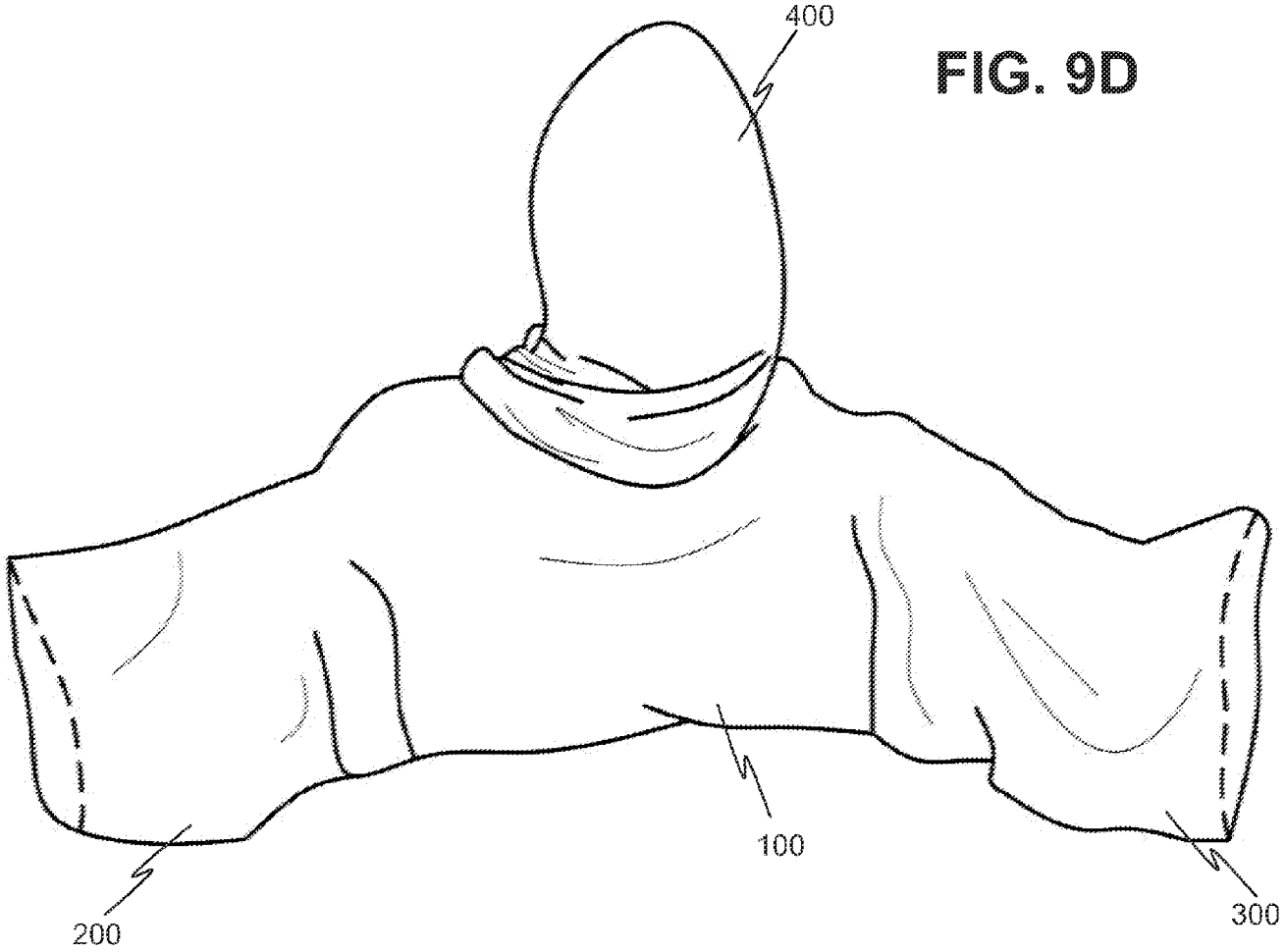
FIG. 9D is a rear view of the embodiment in FIG. 9C.

FIG. 9D illustrates the back view of such embodiment. Pane portion 400 is seen as a hood like feature around the back of the head.

Figure 10A:
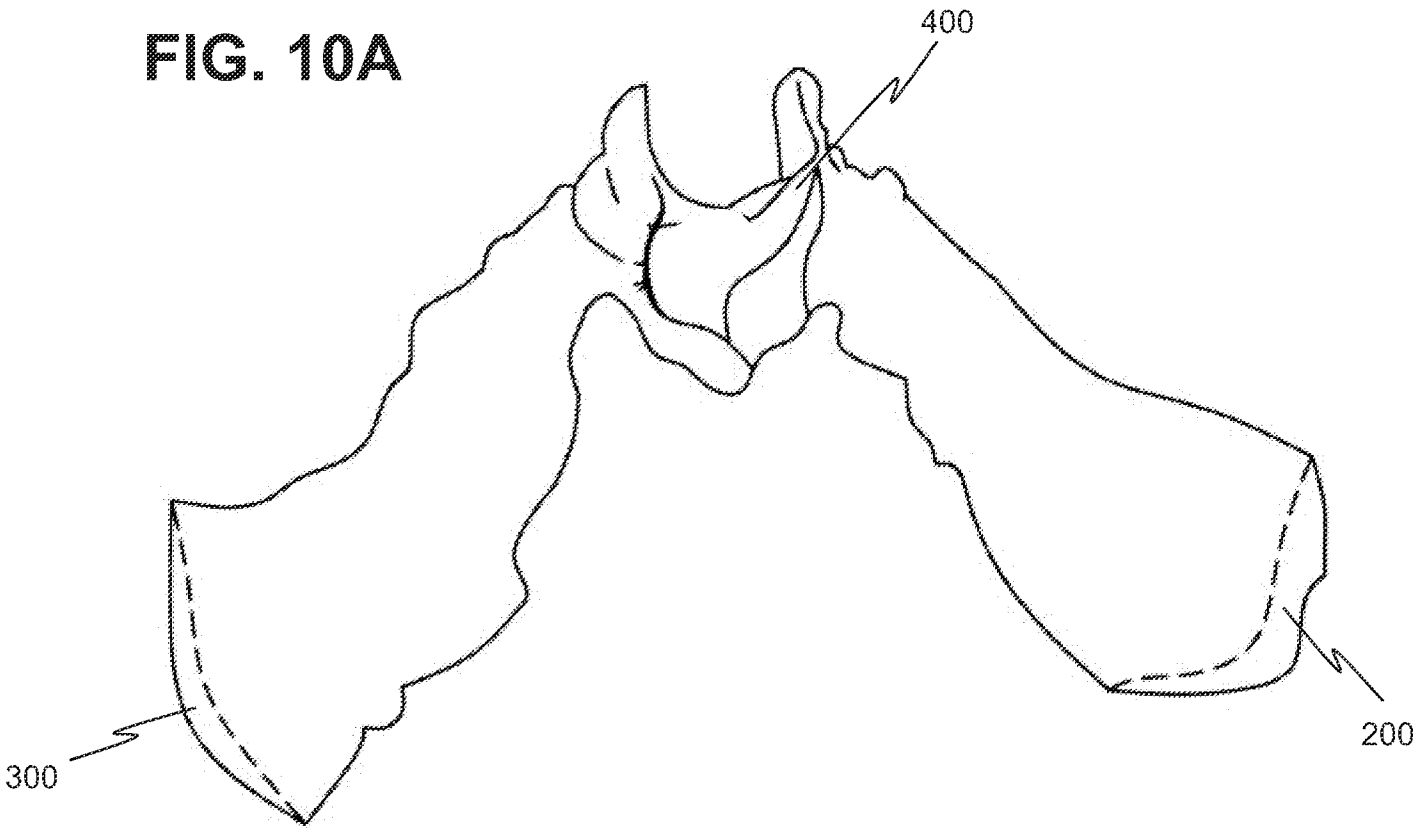
FIG. 10A is a front view of another embodiment of the convertible garment worn as a top wear and cowl neck collar wherein the garment opens toward the front and the panel is around the neck line and used as a cowl neck collar.

FIG. 10A illustrates an additional embodiment where the garment opens to the front; arms are placed into tube portions 200, 300 as sleeves. The left and right flaps 82, 84 are at neck line and wrapped across the front and back of the neck in a circular fashion to create a cowl neck collar. The end of panel portion 100 is tucked under the collar, creating a continuous look.

Figure 10B:
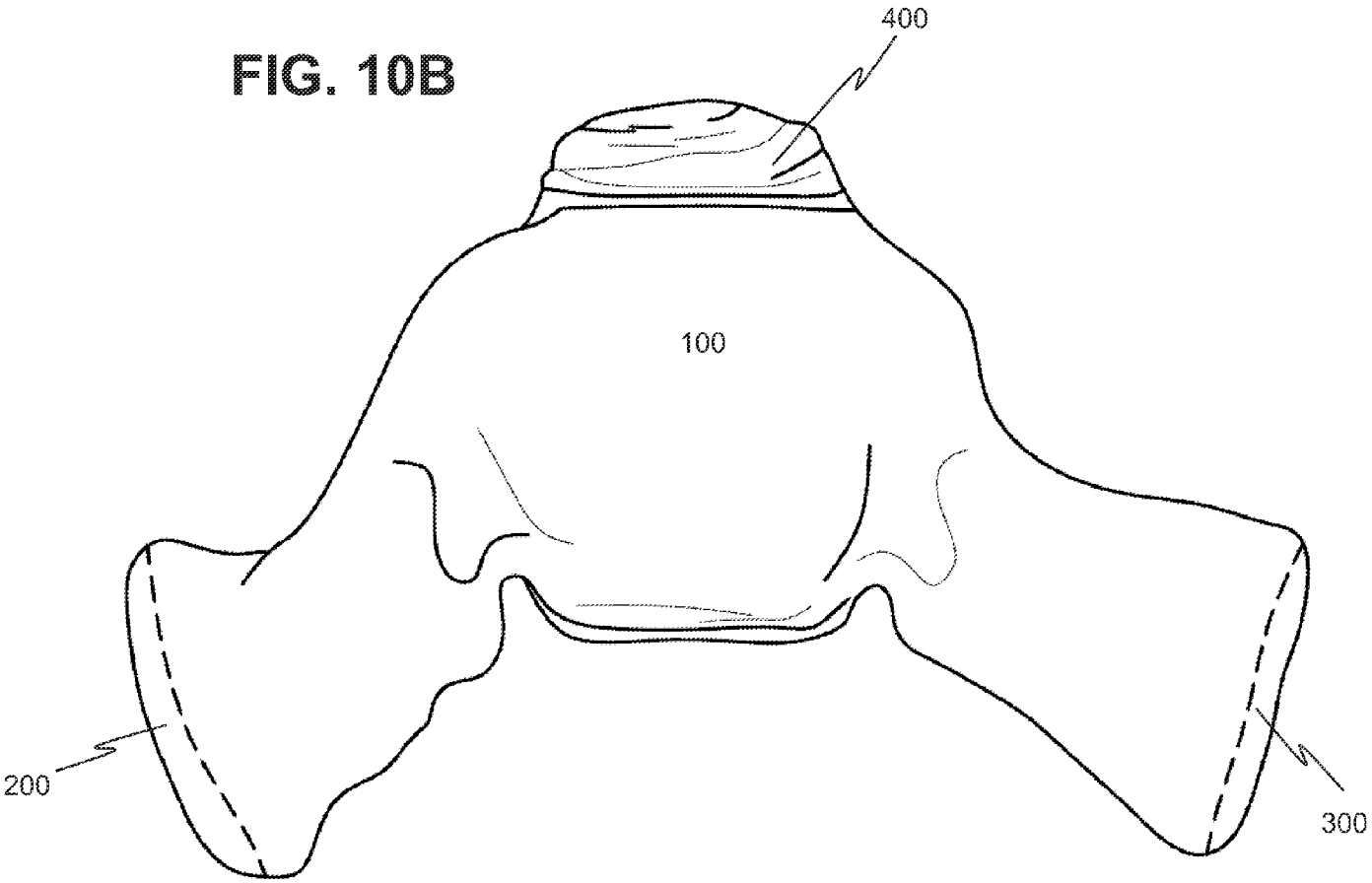
FIG. 10B is a rear view of the embodiment in FIG. 10A.

FIG. 10B illustrates the back view of the same embodiment.

Figure 11A:
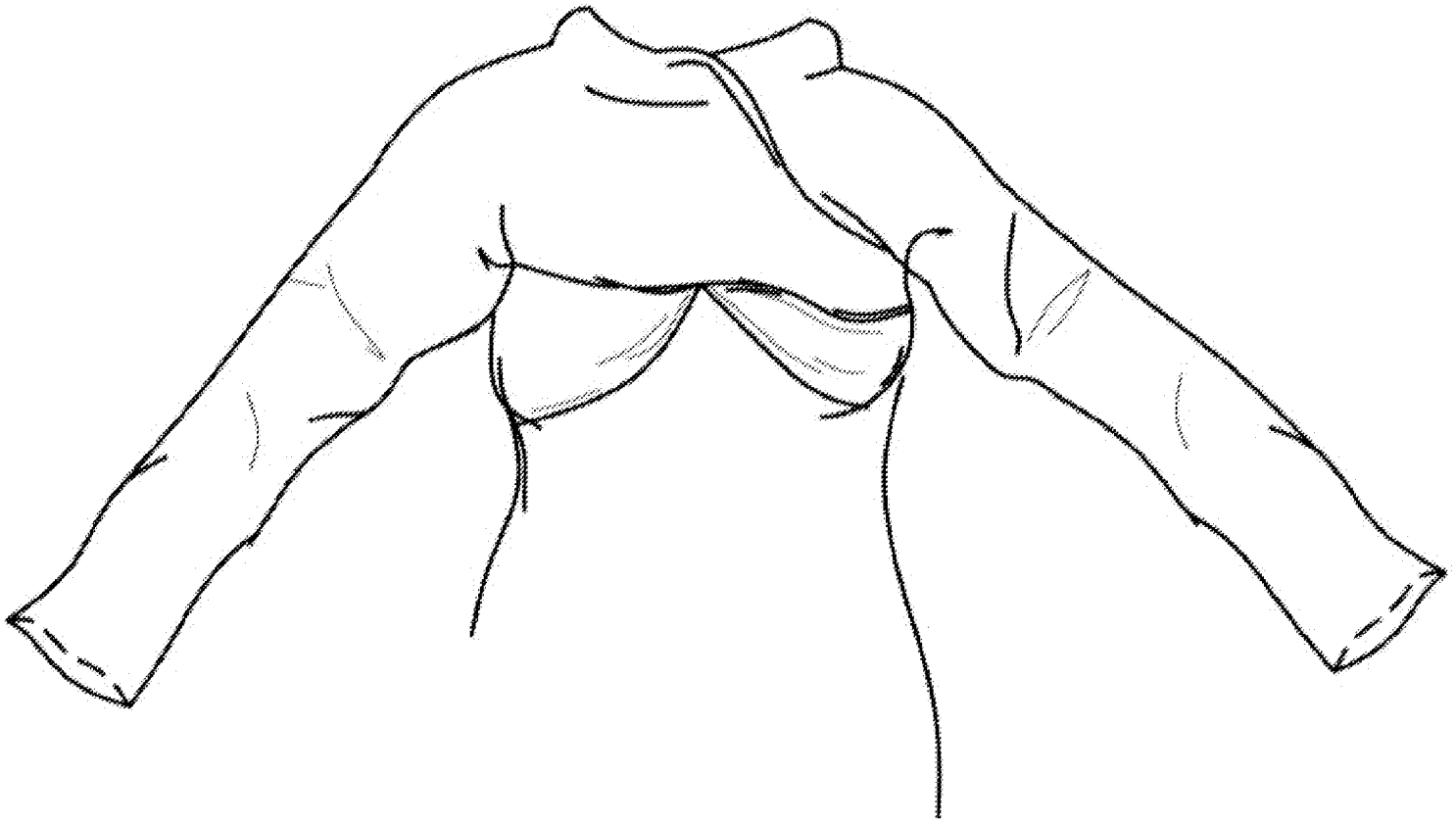
FIG. 11A is a front view of another embodiment of the convertible garment worn as an oriental style wrap wherein the garment opens toward the front and the panel is around the neck line and crisscrossed over mid chest and tied in back.

FIG. 11A illustrates an additional embodiment of the invention where the garment opens toward the front; arms are place in tube portions as sleeves. The flaps of the panel portion are at neck line, crisscrossed over mid chest, taken to the back of the body, and the corners of panel portion is tied and tucked under the back of the garment to create an oriental style wrap.

Figure 11B:
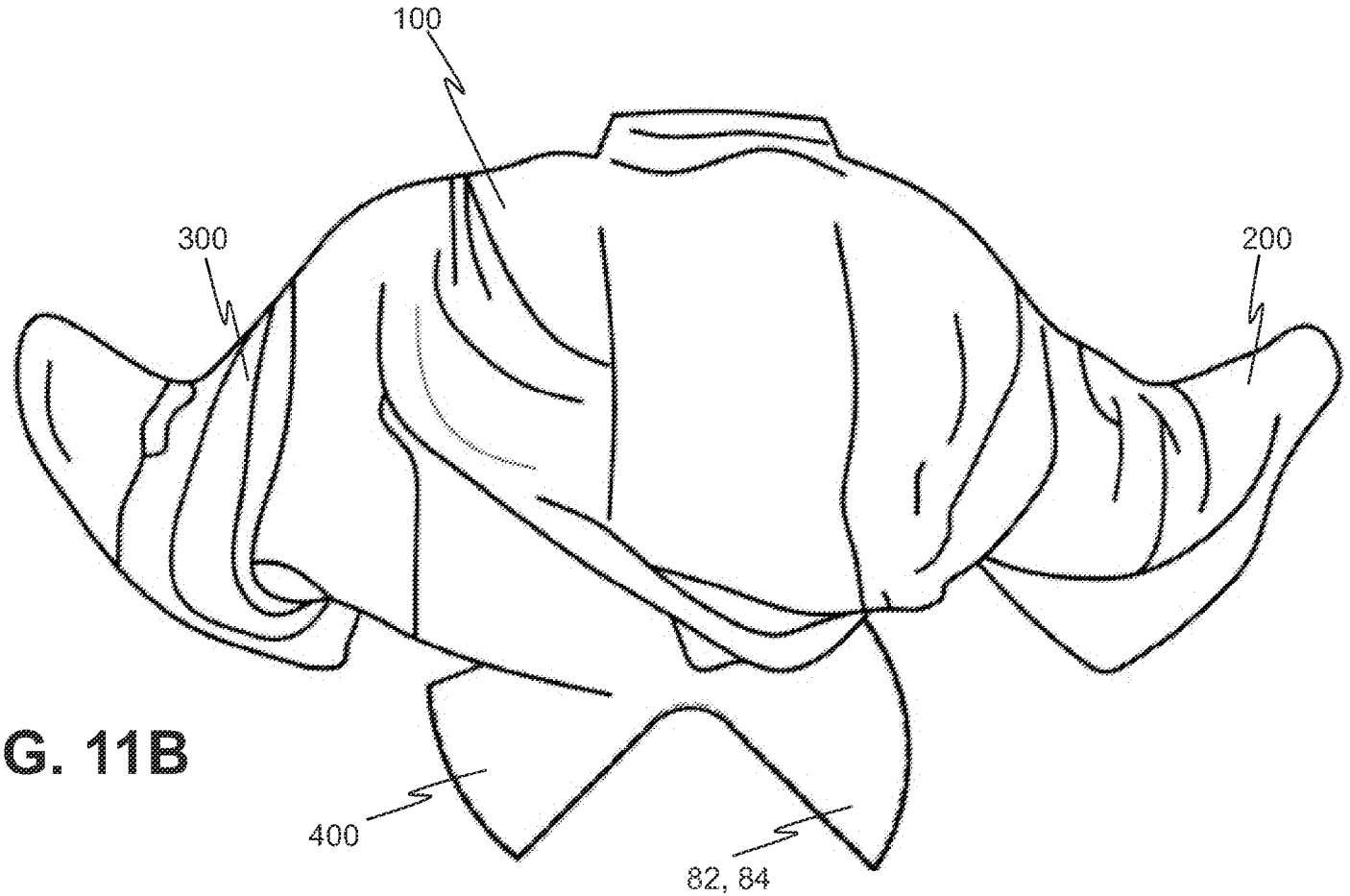
FIG. 11B is a rear view of the embodiment in FIG. 11A.

FIG. 11B illustrates the back view of the embodiment. The tube portions 200, 300 are seen as the sleeves of the garment in this view.

Figure 11C:
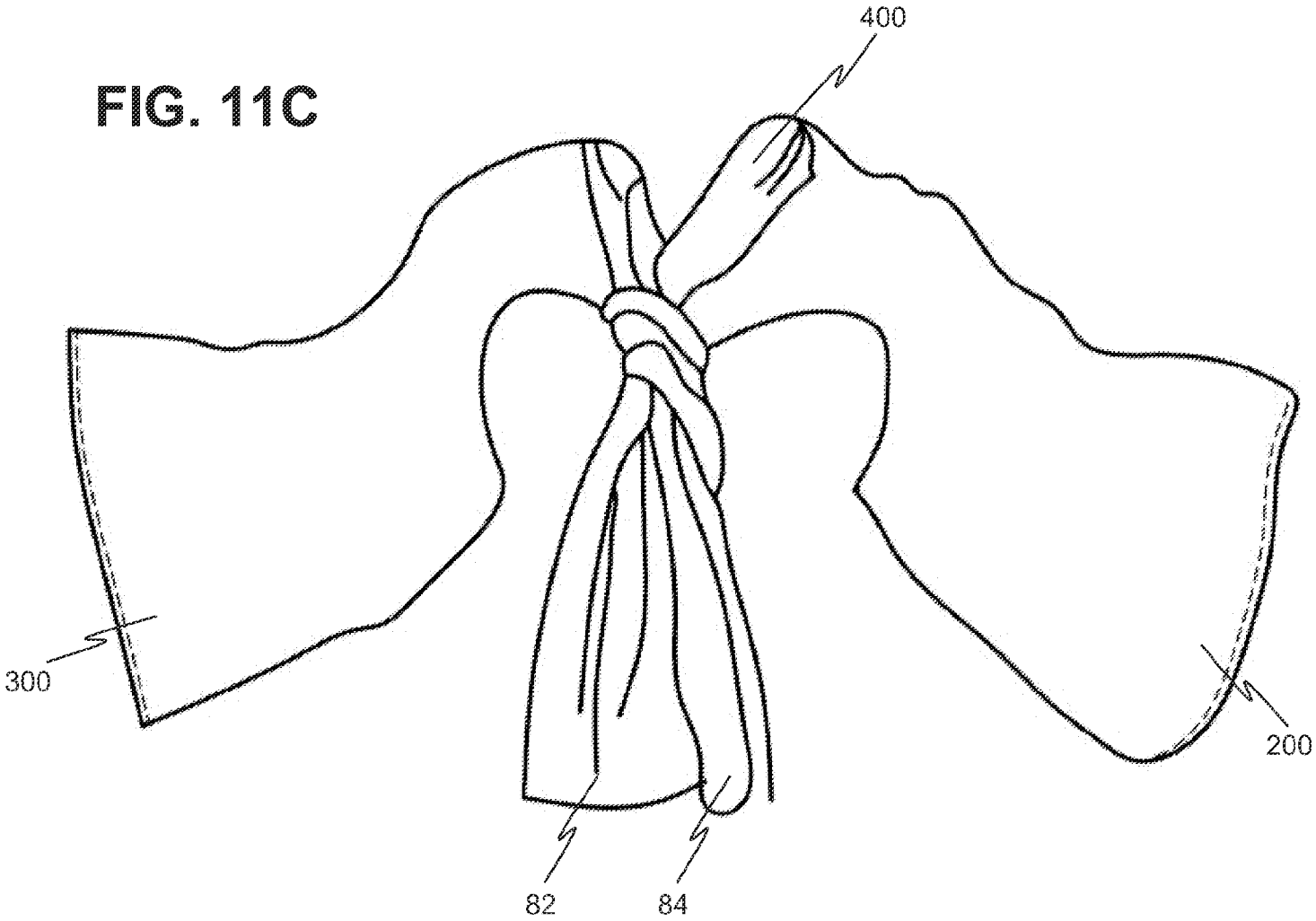
FIG. 11C is a front view of another embodiment of the convertible garment worn as a knot shrug shawl wherein the garment opens toward the front and the panel is around the neck line and tied in a knot.

FIG. 11C Illustrates an additional embodiment where the garment opens towards the front, arms are placed into tube portions 200, 300 as sleeves and the flaps 82, 84 of panel portion 100 are tied in front with a low hanging knot.

Figure 11D:
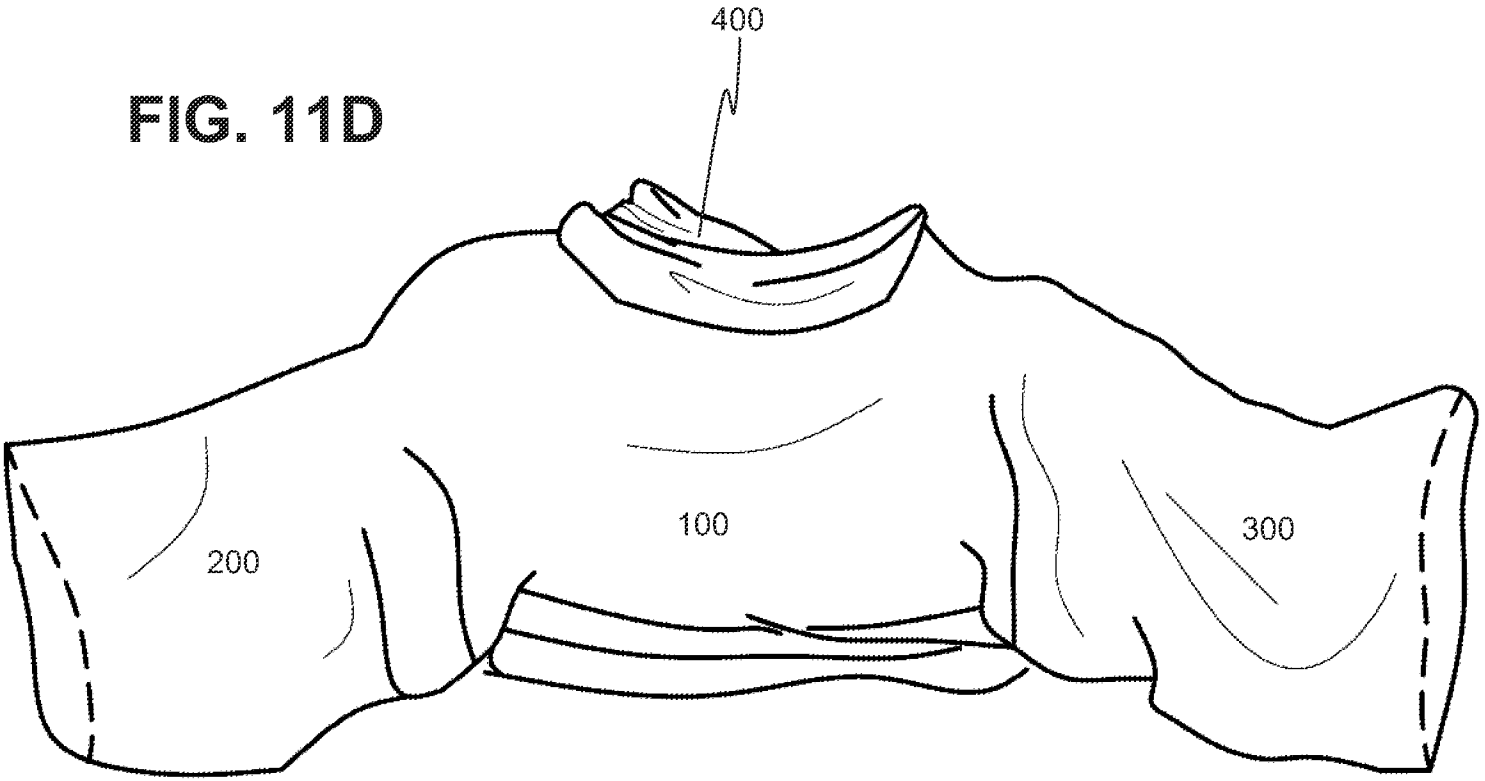
FIG. 11D is a rear view of the embodiment in FIG. 11C.

FIG. 11D illustrates the back view of FIG. 11C.

Alternatively, the garment 10 can be worn in a way that the garment is inverted and opens towards the front. The body portion 100 is on the top of the garment 10 and the panel portion 400 is on the bottom of the garment 10. In this way, the body portion 100 is being worn on one's back, the two tubes 200, 300 are being worn as arm sleeves, the panel portion 400 is being wrapped around ones hip level. This usage lends itself to a vast variety of styles/fashions most of which are shown in FIGS. 12A-16B. In these styles/fashions, the garment is inverted and opens toward the front.

Figure 12A:
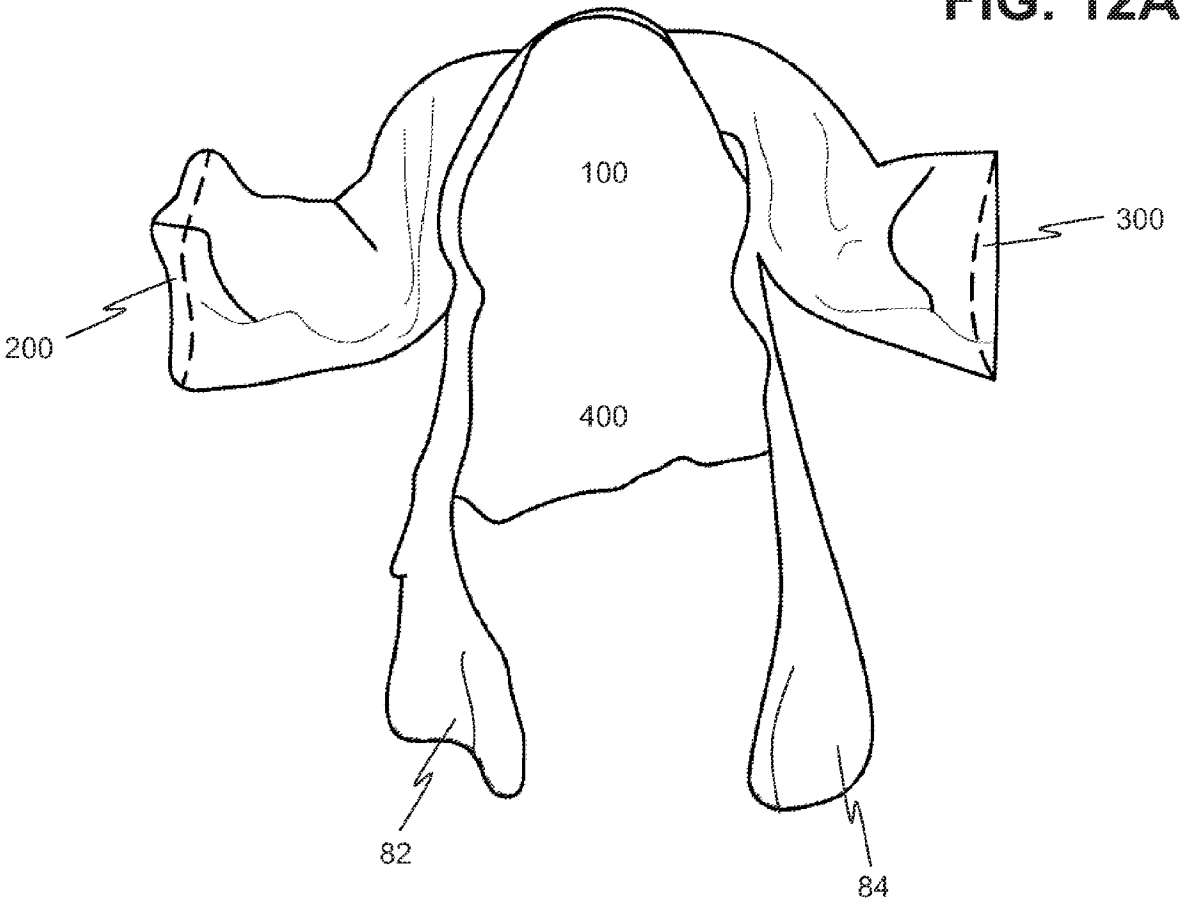
FIG. 12A is a front view of an embodiment of the convertible garment worn as a top wear wherein the garment is inverted and opens toward the front and the panel is around the hip level.

FIG. 12A illustrates an embodiment wherein the garment 10 is inverted and opens toward the front; arms are placed into tube portions 200, 300 as sleeves; flaps 82, 84 of panel portion 400 are draping down at hip level and are intended to hang loosely as flaps in the front.

Figure 12B:
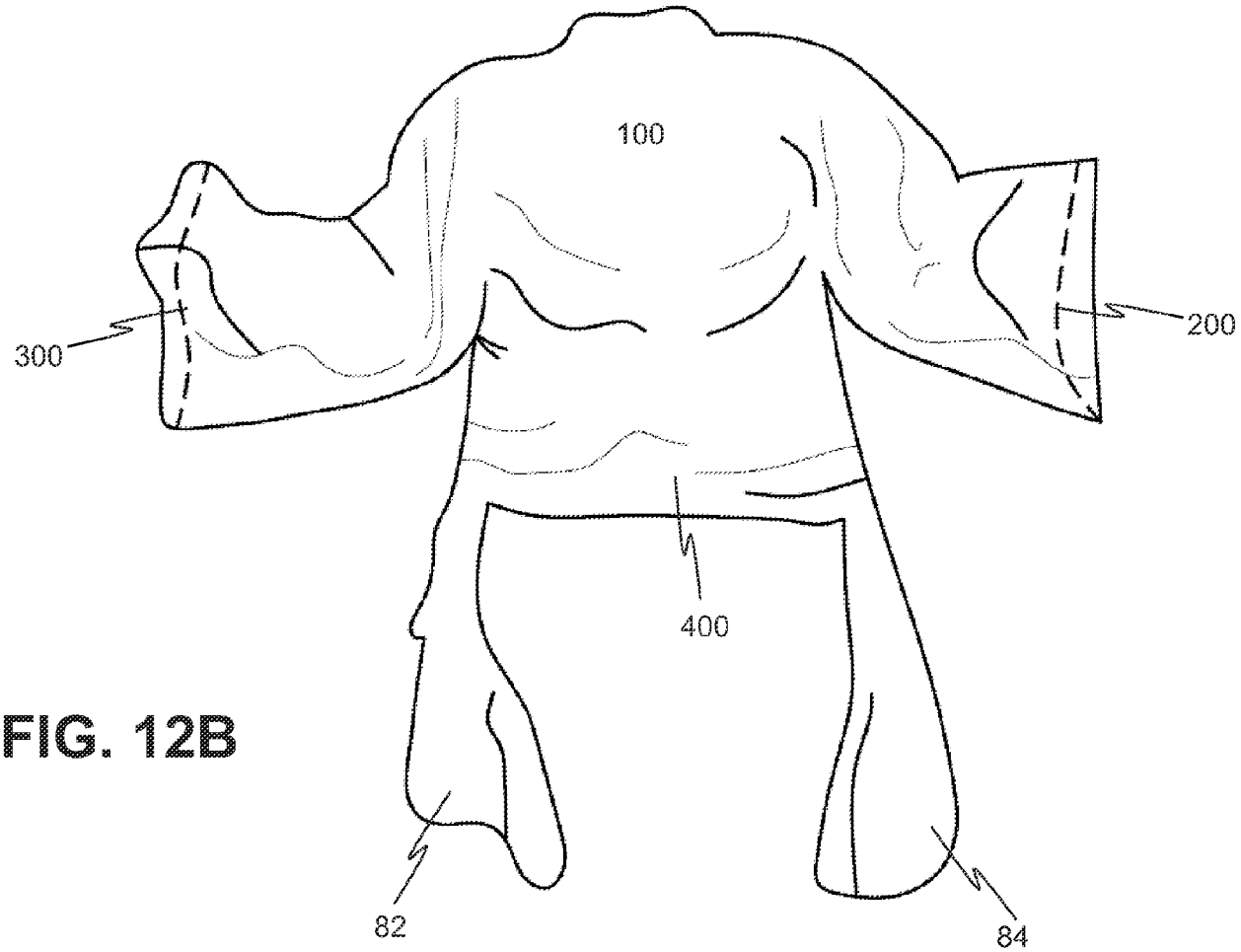
FIG. 12B is a rear view of the embodiment in FIG. 12A.

FIG. 12B illustrates the back view of this free flowing hanging garment style.

Figure 13A:
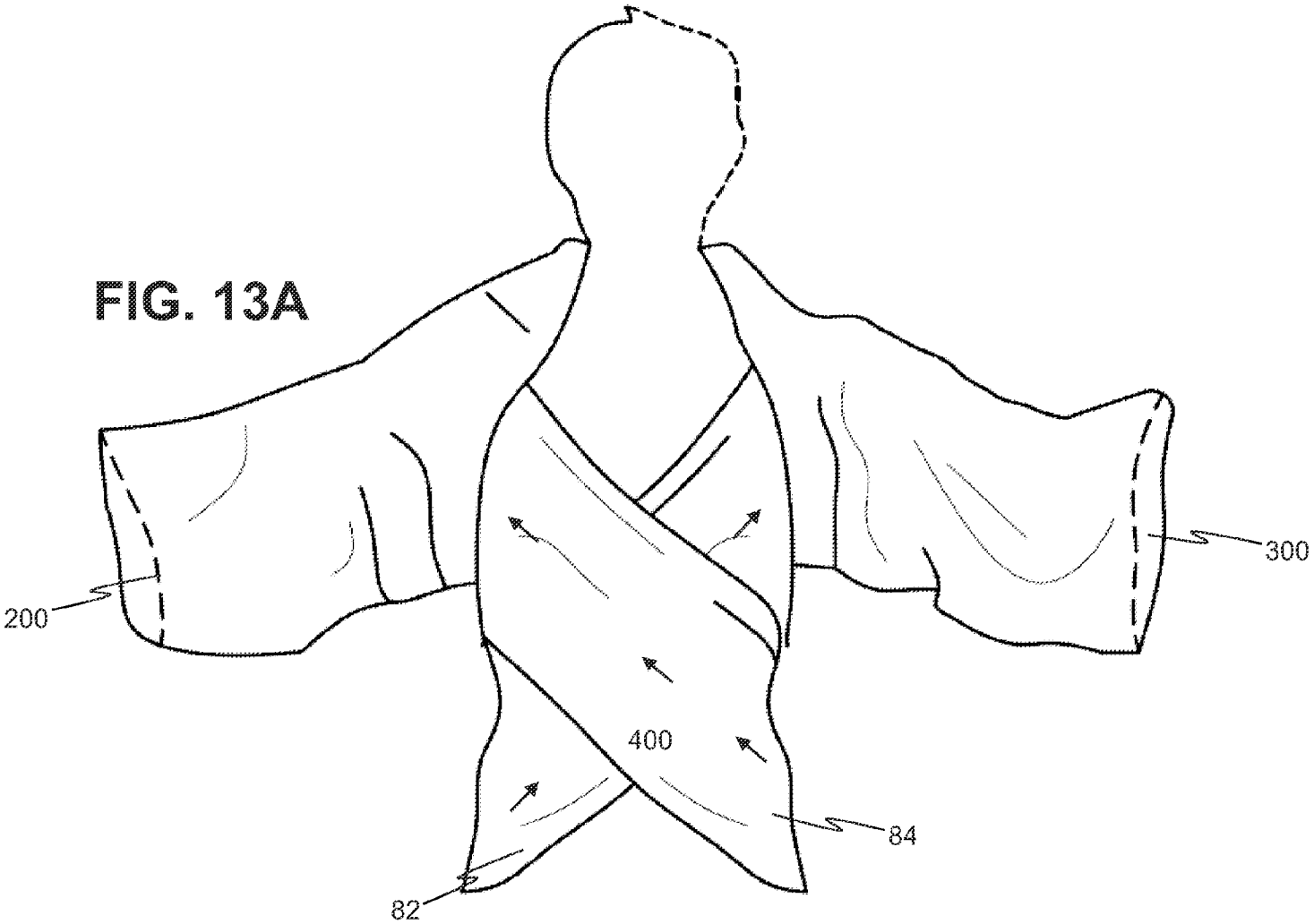
FIG. 13A is a front view of another embodiment of the convertible garment worn as a top wear wherein the garment is inverted and opens toward the front and the panel is around the hip level, creating a full top that can be worn with or without another top.

FIG. 13A illustrates an additional embodiment. In a fashion, similar to the previous embodiment presented in FIG.

12A, the garment 10 herein is inverted and opens towards the front; body portion 100 is worn on one's back; arms are placed into tube portions 200, 300 as sleeves. Flaps 82, 84 of the panel portion 400 are draping at hip level. The left flap is crossed over the font of the body and tucked into the right sleeve of the tube portion. The right flap is also crossed over the top of other panel and tucked into the left sleeve of the tube portion. This approach Creates a full top that can be worn with or without another top.

Figure 13B:
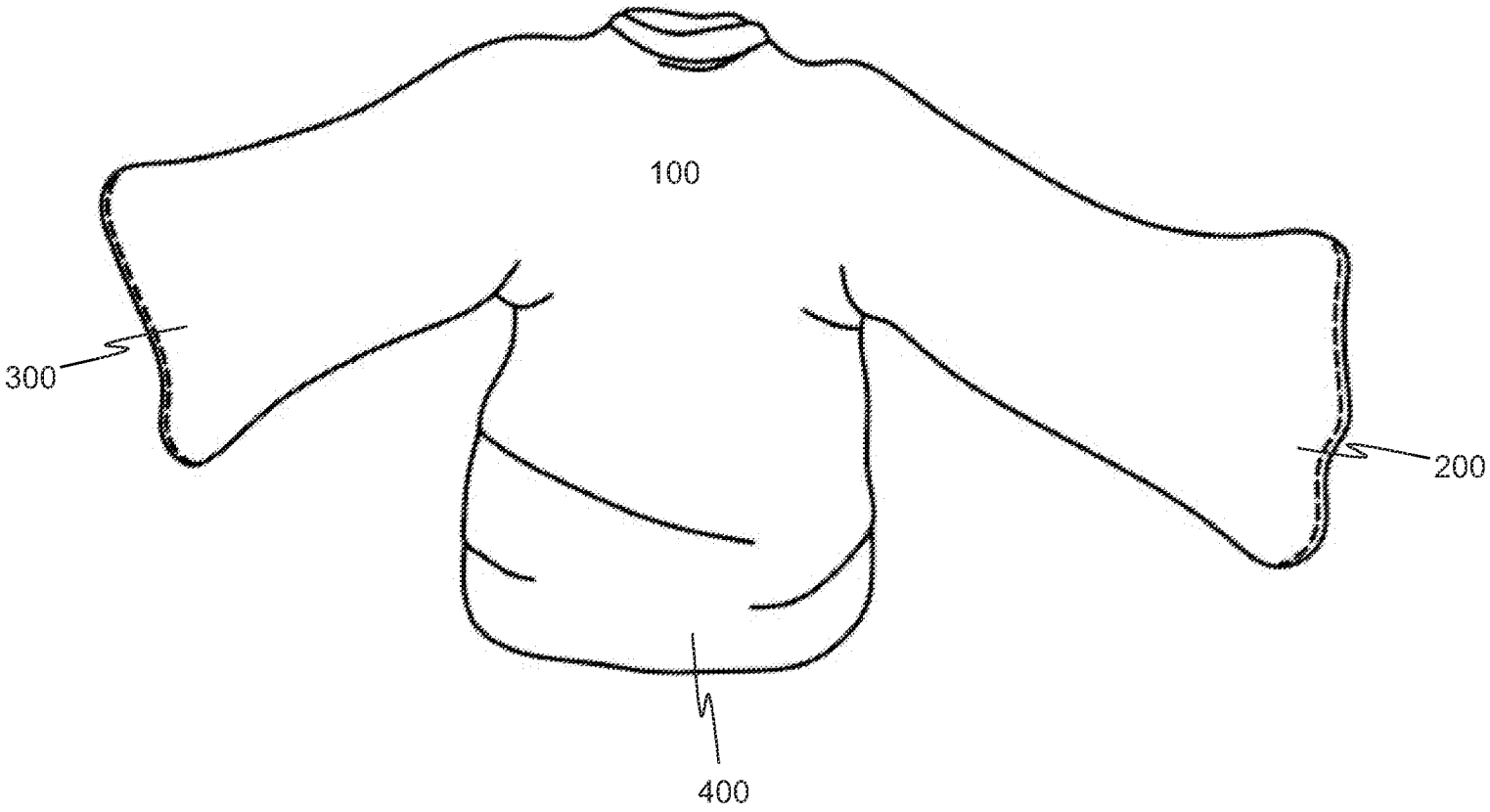
FIG. 13B is a rear view of the embodiment in FIG. 13A.

FIG. 13B illustrates the back view of said embodiment FIG. 13A.

Figure 14A:
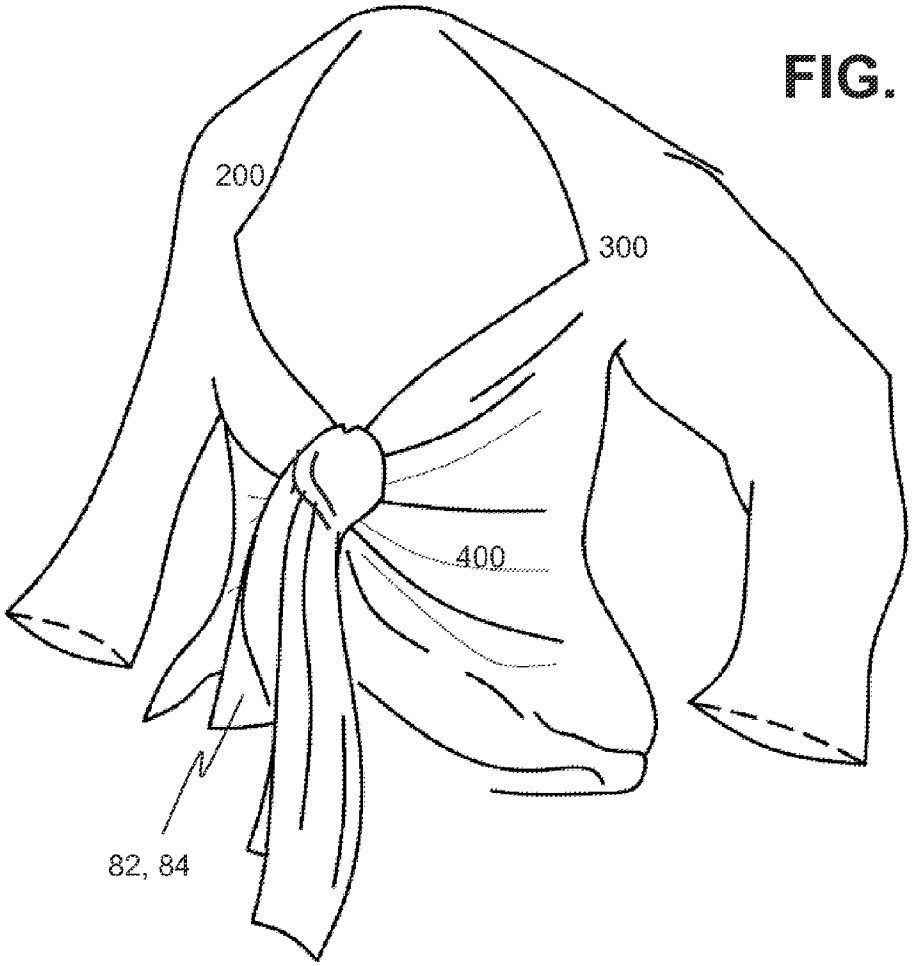
FIG. 14A is a front view of another embodiment of the convertible garment worn as a top wear wherein the garment is inverted and opens toward the front and the panel is around the hip level.

FIG. 14A illustrates an additional embodiment wherein the garment is inverted and opens towards the front; the body portion 100 is worn on one's back; one's arms are placed into tube portions 200, 300 as sleeves. Flaps 82, 84 of panel portions 400 are draping down at the hip level and are tied in front to create a diamond shape front, to accent any additional garments the user may choose to wear in conjunction with said invention.

Figure 14B:
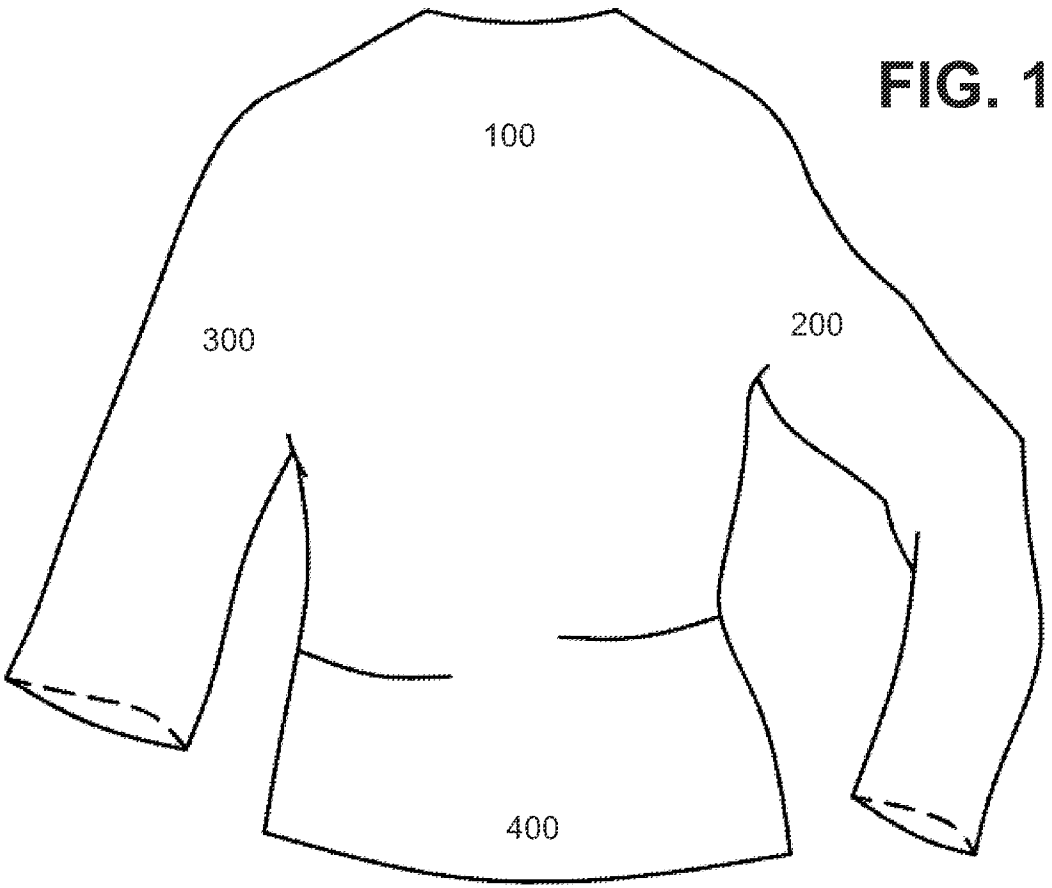
FIG. 14B is a rear view of the embodiment in FIG. 14A.

FIG. 14B illustrates the back view of FIG. 14A.

Figure 14C:
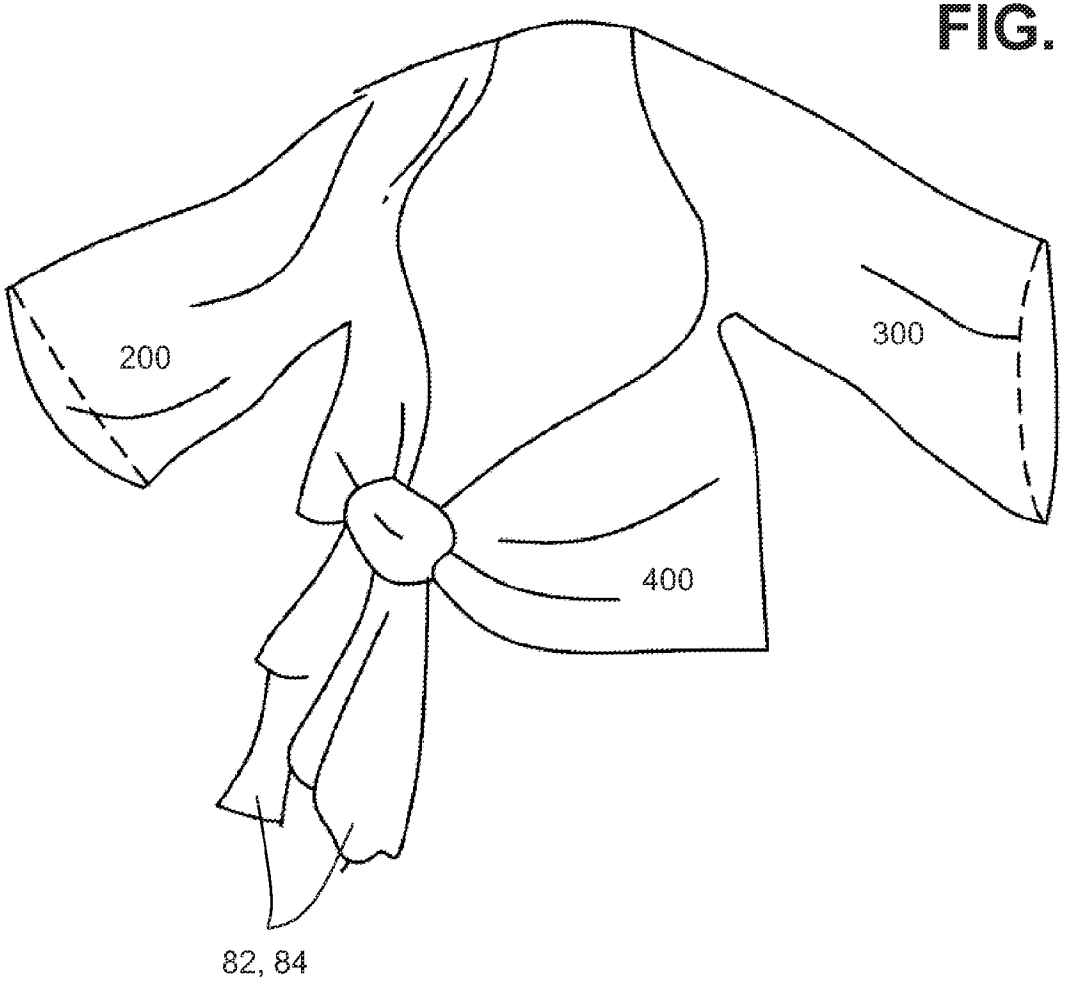
FIG. 14C is a front view of another embodiment of the convertible garment worn as a top wear wherein the garment is inverted and opens toward the front and the panel is around the hip level.

FIG. 14C illustrates an additional embodiment wherein arms are placed into the tube portions 200, 300 as sleeves. Flaps 82, 84 of the panel portion 400 are draping downward at hip level and tied off low down to one side.

Figure 14D:
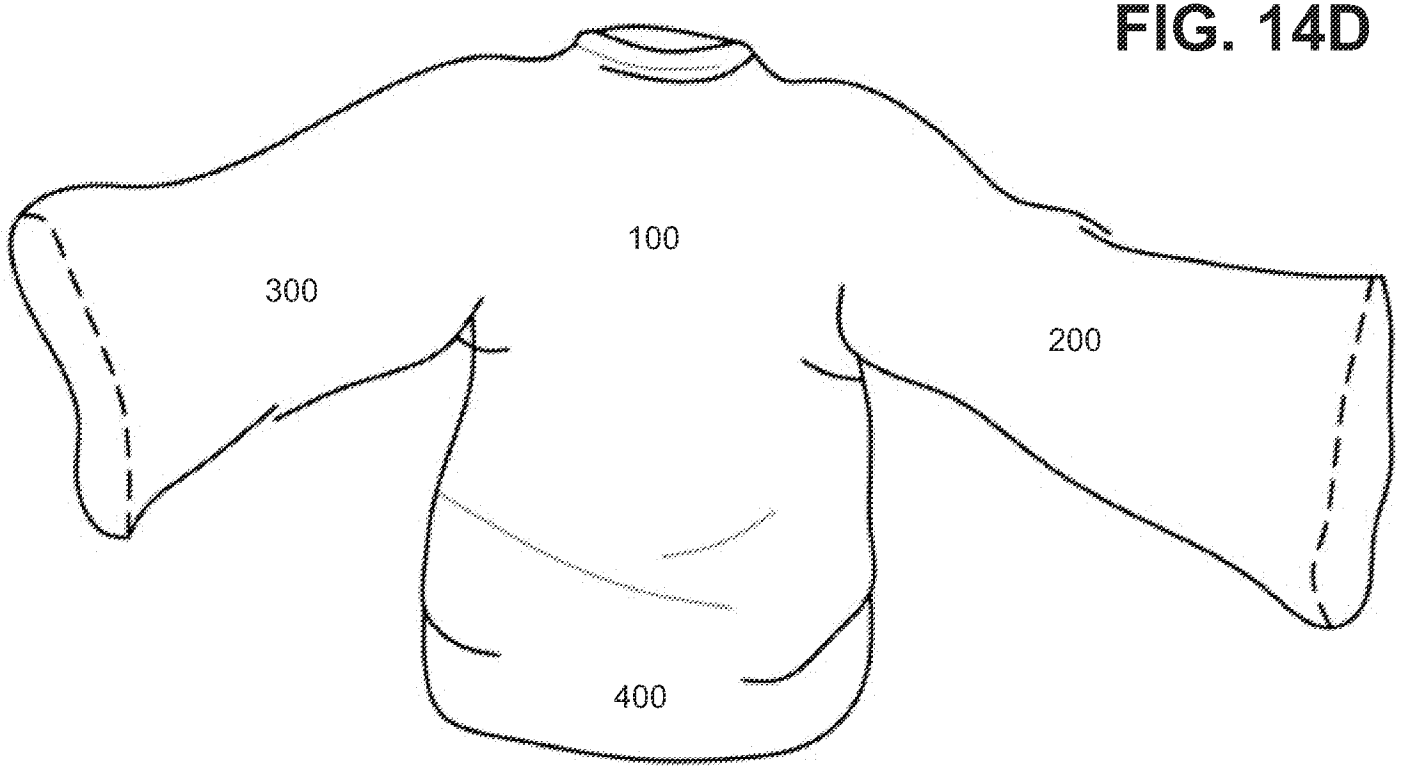
FIG. 14D is a rear view of the embodiment in FIG. 14C.

FIG. 14D illustrates the back view of FIG. 14C.

Figure 15A:
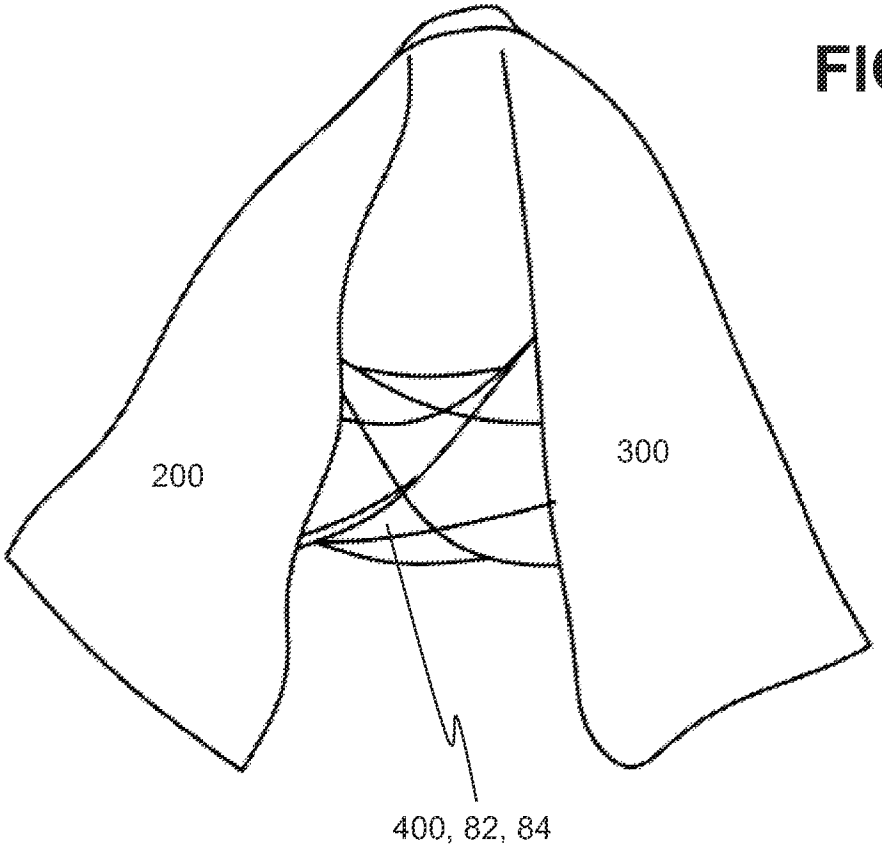
FIG. 15A is a front view of another embodiment of the convertible garment worn as a top wear wherein the garment is inverted and opens toward the front and the panel is around the hip level.

FIG. 15A illustrates an additional embodiment wherein said garment is inverted and opens towards the front. Arms are placed into tube portions 200, 300 as sleeves. Flaps 82, 84 of panel portion 400 are draping downward at hip level and are crisscrossed around the waistline wherein they are tied off in the back. Panel portion 400 can be adjusted up to cover more of the frontal area.

Figure 15B:
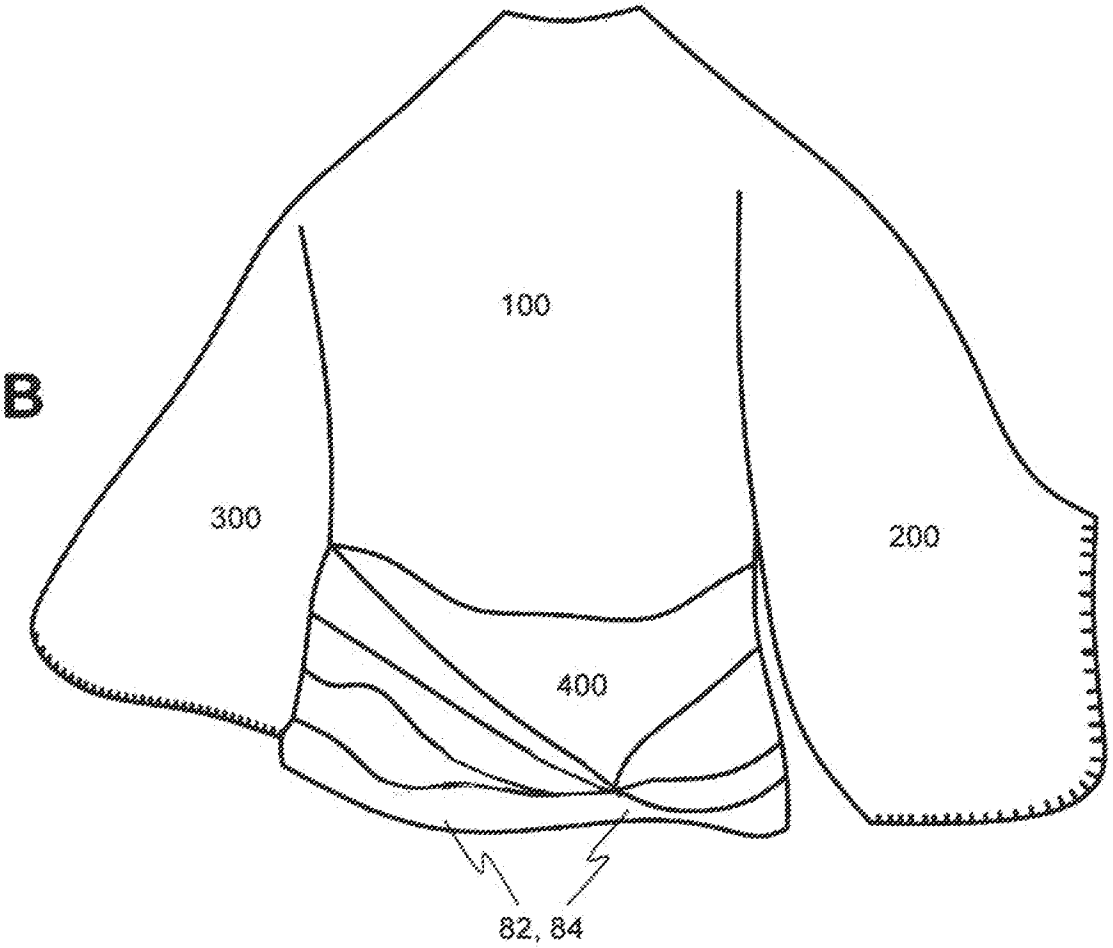
FIG. 15B is a rear view of the embodiment in FIG. 15A.

FIG. 15B illustrates the back view of FIG. 15A.

Figure 16A:
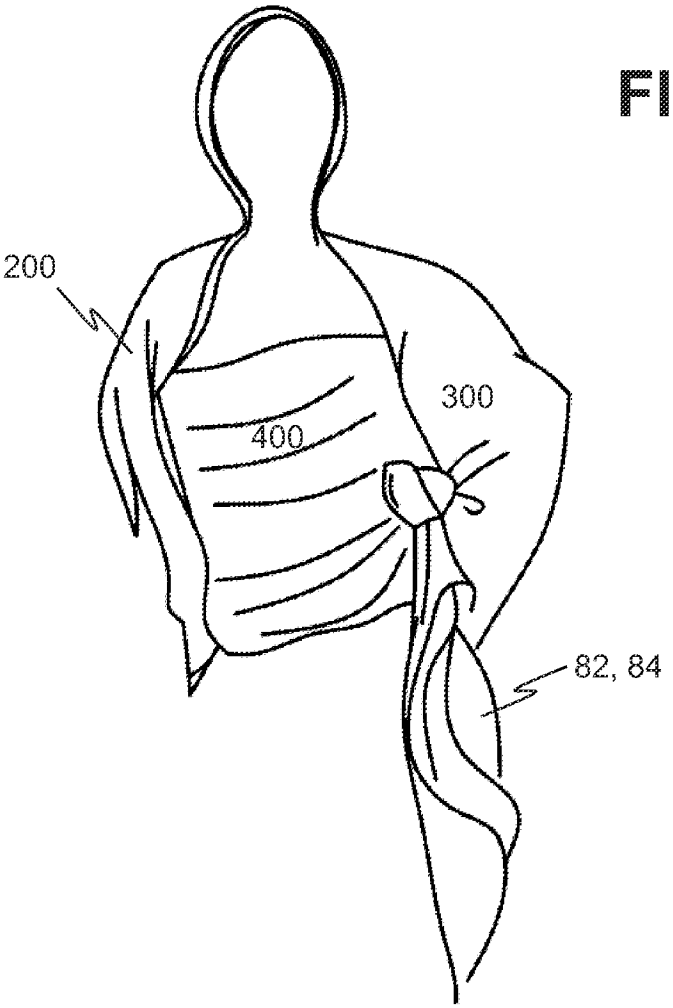
FIG. 16A is a front view of another embodiment of the convertible garment worn as a top wear wherein the garment is inverted and opens toward the front and the panel is around the hip level.

FIG. 16A illustrates an additional embodiment wherein the garment is inverted and opens toward the front. Arms are placed into tube portions 200, 300 as sleeves. Flaps 82, 84 of panel portion 400 are draping downward at one's hip level. One flap 82 or 84 of the panel portion is crossed over the front of the body and tucked into one of the tube portions 200 or 300, creating a top with a hanging flap.

Figure 16B:
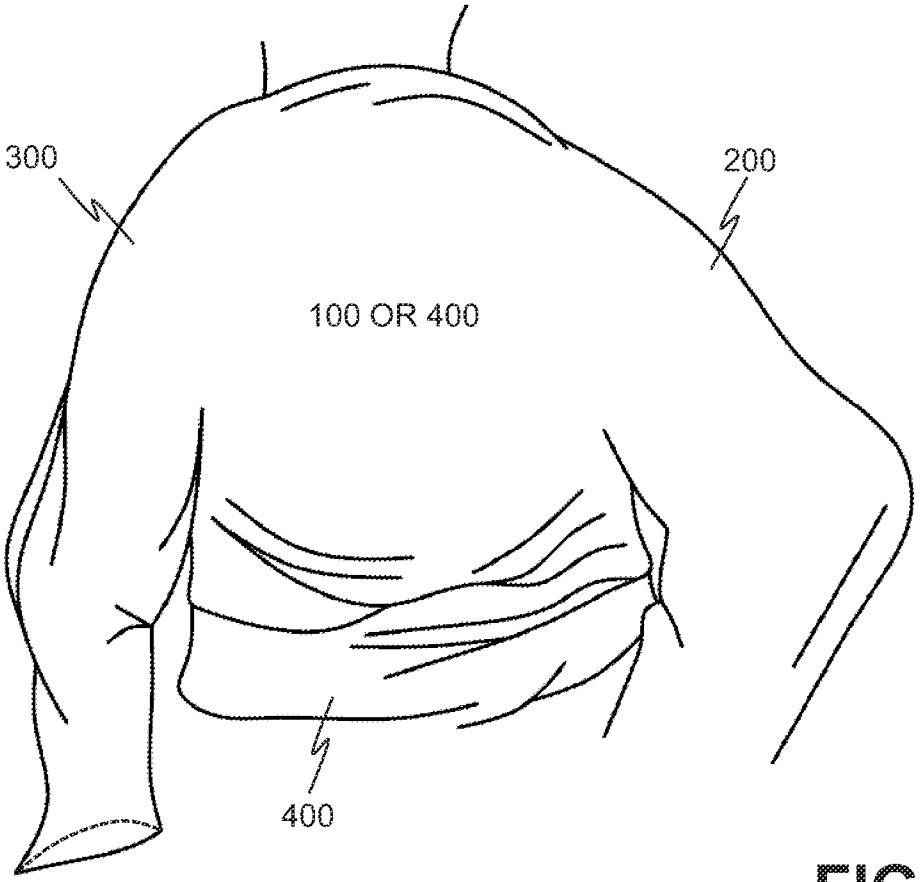
FIG. 16B is a rear view of the embodiment in FIG. 16A.

FIG. 16B illustrates the back view of FIG. 16A.

Similar to the aforementioned fashions/styles wherein the garment 10 can be worn with the body portion 100 being on the top and the panel portion 400 being on the bottom of the garment, another usage is where the body portion 100 in these styles/fashions is worn on one's chest. In this usage the garment is inverted and opens towards the back. These styles/fashions are illustrated in FIGS. 17A-17E.

Figure 17A:
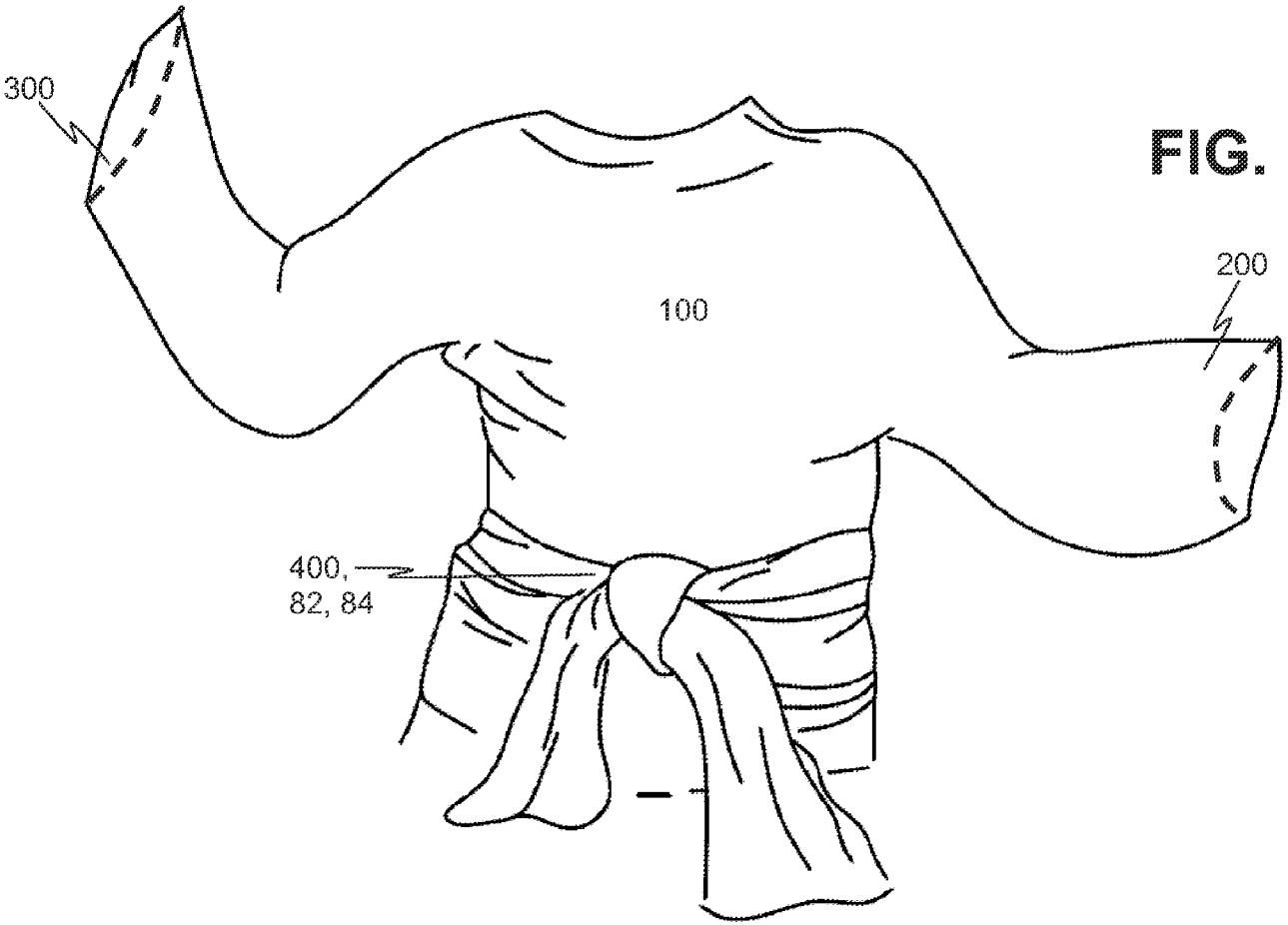
FIG. 17A is a front view of another embodiment of the convertible garment worn as a top wear wherein the garment is inverted and opens toward the back and the panel is around the hip level.

FIG. 17A illustrates an additional embodiment wherein the garment is inverted and worn with the opening towards the back and the body portion 100 worn in the front; arms are placed into tube portions 200, 300. The panel portion 400 is hanging down in the back. The top neckline of garment 10 may be adjusted to fit comfortably around the neck. Flaps 80 or 82 of panel portion 400 are crisscrossed at the back, brought around to the front of the body and tied in the center front.

Figure 17B:
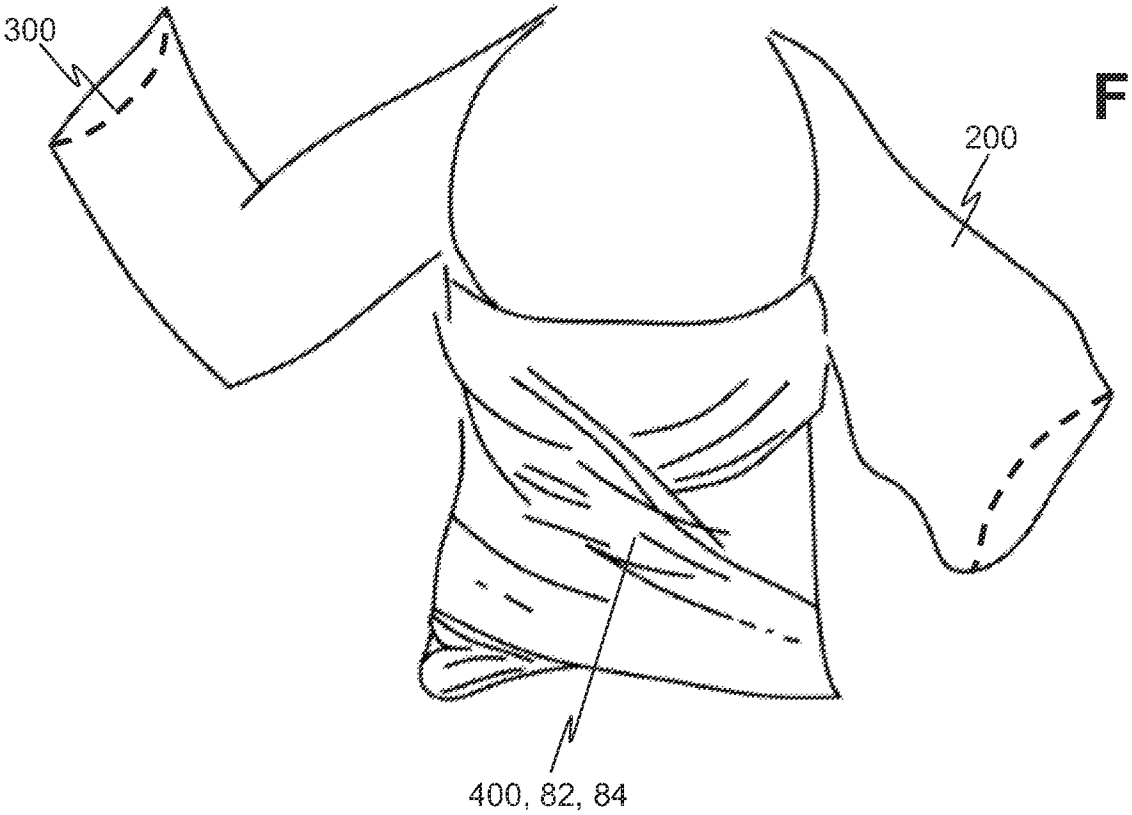
FIG. 17B is a rear view of the embodiment in FIG. 17A.

FIG. 17B illustrates the back view of FIG. 17A.

Figure 17C:
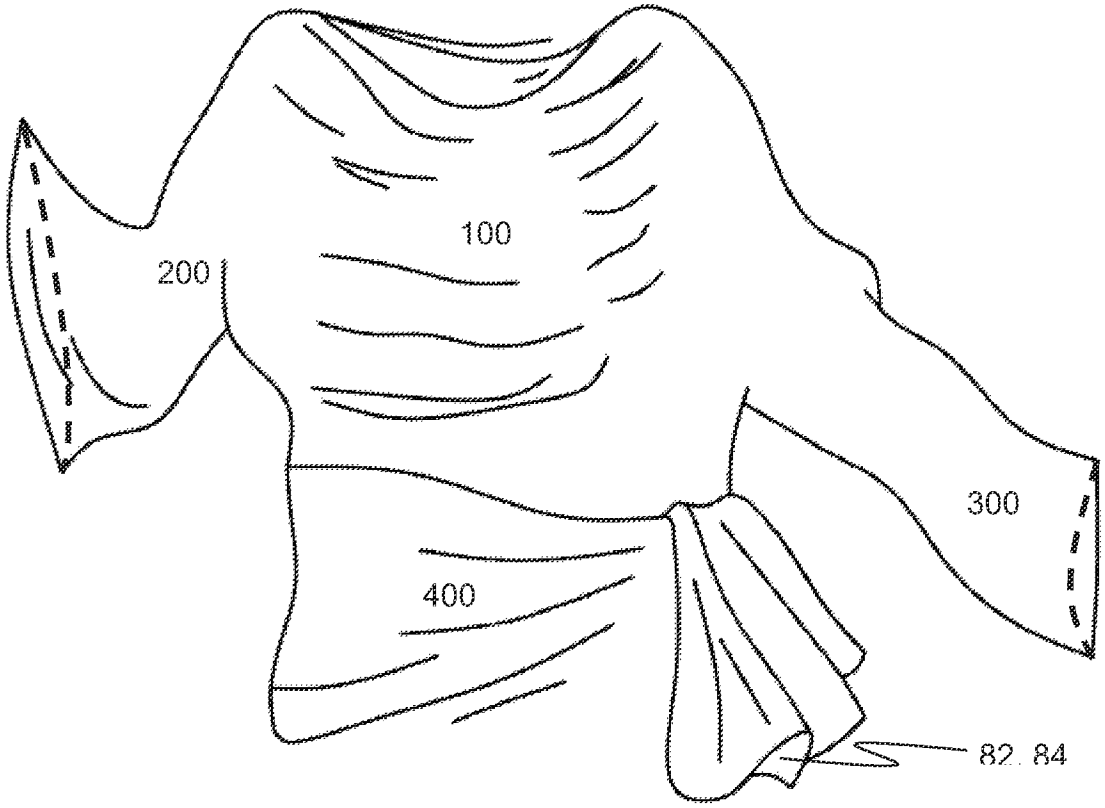
FIG. 17C is a front view of another embodiment of the convertible garment worn as a top wear wherein the garment is inverted and opens toward the back and the panel is around the hip level.

FIG. 17C illustrates an additional embodiment wherein the garment is inverted and opens towards the back. Arms are placed into tube portions 200, 300 backwards, with panel section 400 hanging off from the back. The top of garment is adjusted to fit comfortably around the neck. The flaps 80, 82 of panel section 400 are crisscrossed around the waistline and tied low to the side of the body.

Figure 17D:
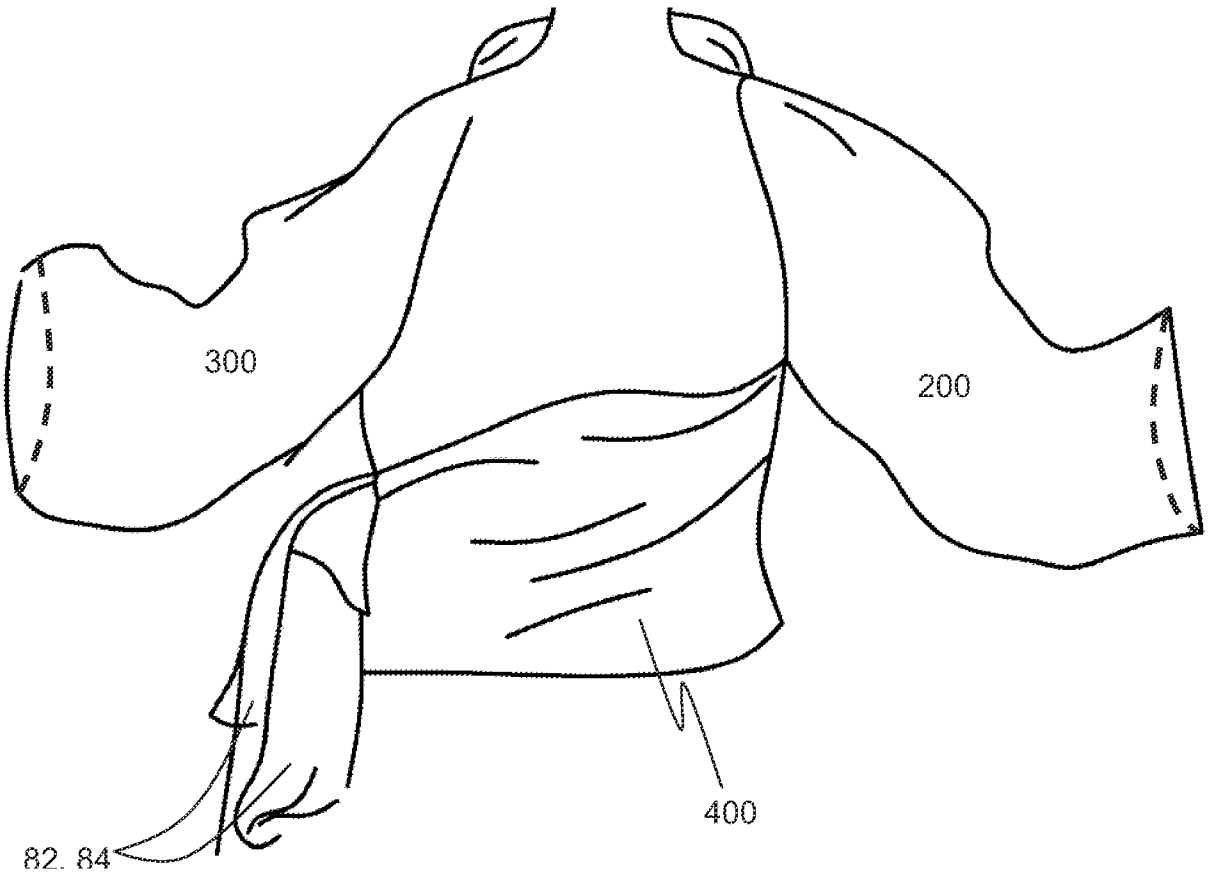
FIG. 17D is a rear view of the embodiment in FIG. 17C.

FIG. 17D illustrates the back view of FIG. 17C.

Figure 17E:
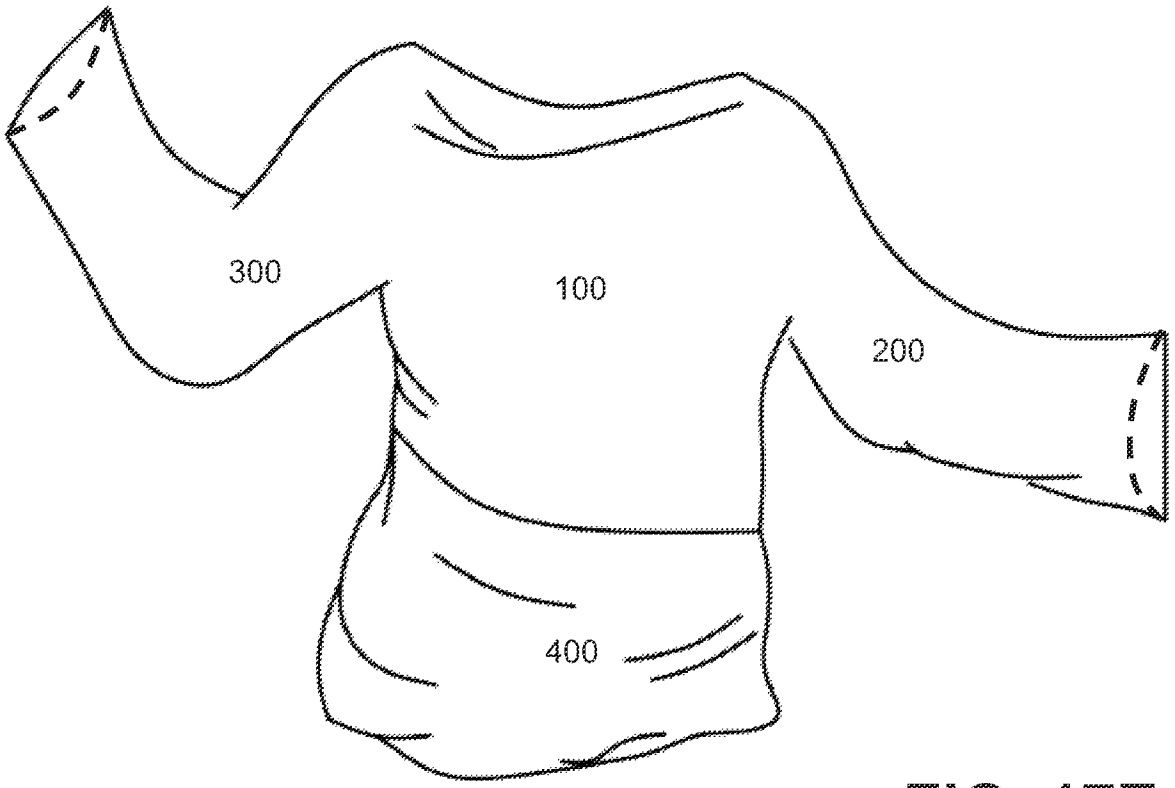
FIG. 17E is a front view of another embodiment of the convertible garment worn as a top wear wherein the garment is inverted and opens toward the back and the panel is around the hip level.

FIG. 17E illustrates an additional embodiment; the garment is inverted and opens towards the back. Arms are placed into tube portions 200, 300, with panel portion 400 hanging off at the back. The top of the garment is adjusted to fit comfortably around the neck. The flaps 82, 84 of panel portion 400 are tied into a knot at the back and fan out as desired.

Figure 17F:
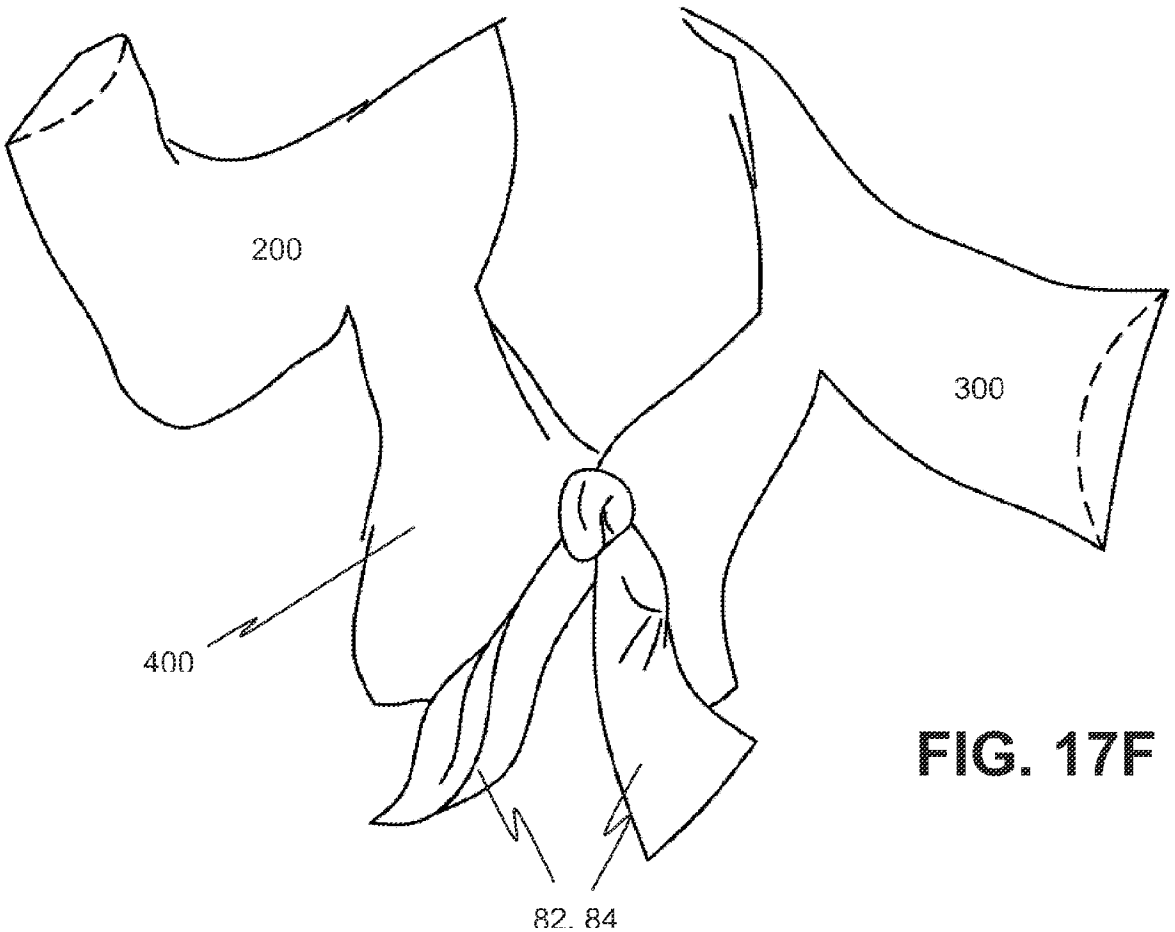
FIG. 17F is a rear view of the embodiment in FIG. 17E.

FIG. 17F illustrates the back view of FIG. 17E.

Figure 18A:
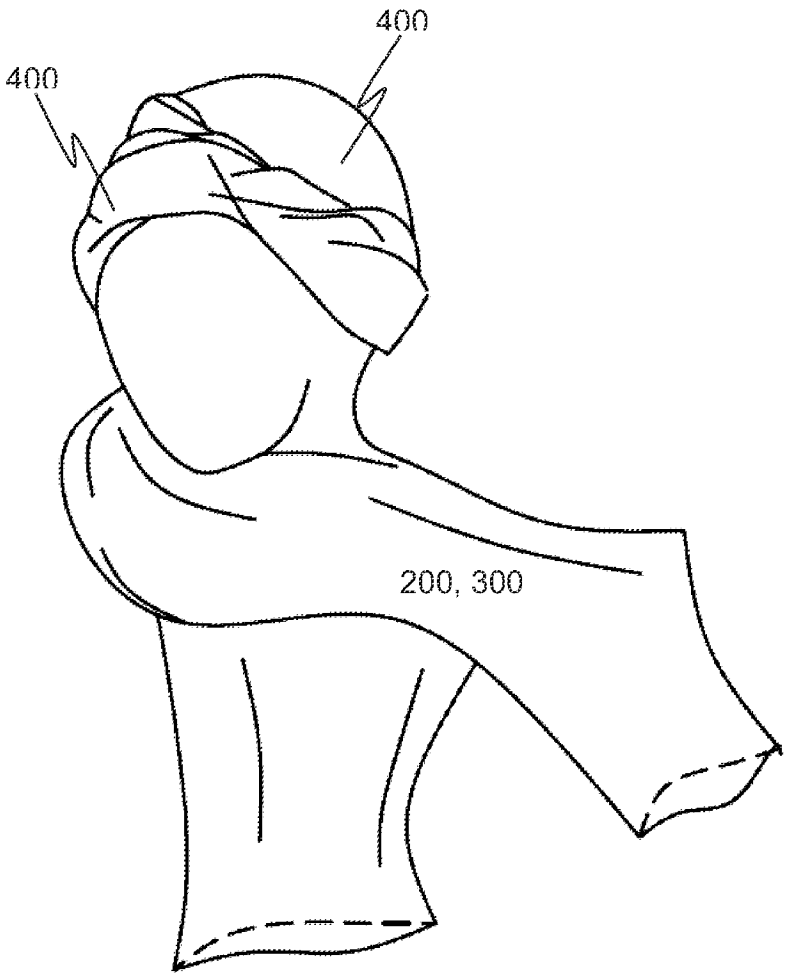
FIG. 18A illustrate an additional embodiment as utilized as a turban type hat and neck shawl.

FIG. 18A illustrate an additional embodiment as utilized as a turban type hat and neck shawl. The panel portion 400 is centered around the shoulders and neck in even proportions on each side like a shawl. One flap 82 or 84 is place over the crown of the head to create a base for the hat. Holding the panel portion 400 in place over the crown of the head, twisting the remaining portion of the flap to the end and wrap around the lowest part of the base part of panel portion 400 in a clockwise direction and tuck under itself. Twist the remaining flap 84 or 82 of the panel portion 400 across the back in the opposite direction and tuck, creating a rim for the hat or turban portion or it can be left to hang down at the back. The tube portions 200, 300 can be folded upward to create a scarf effect or downward to create a shawl effect, thus eliminating the draft that results when a separate hat and scarf are worn. This style can be worn inside or outside of a coat and can be worn by men as a turban and women as head dress and coverings.

Figure 18B:
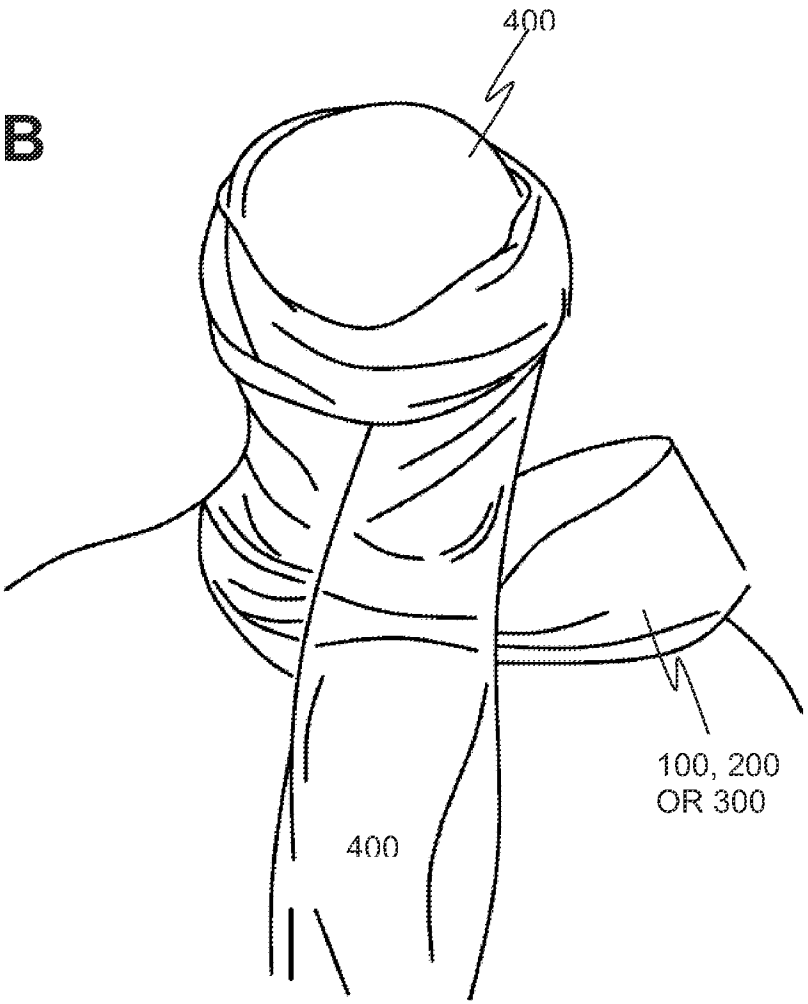
FIG. 18B is a rear view of the embodiment in FIG. 18A.

FIG. 18B illustrates the back view of FIG. 18A.

Figure 19A:
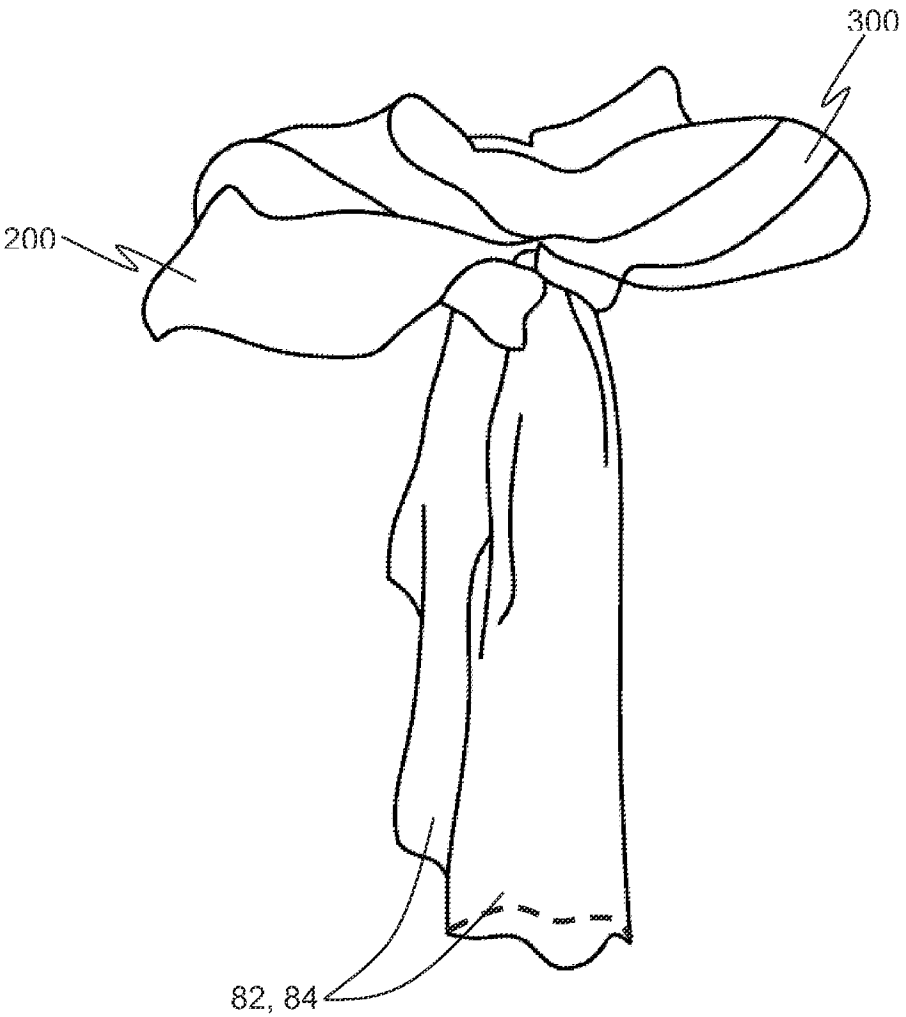
FIG. 19A is a front view of another embodiment of the convertible garment which is worn as a neck shawl or scarf.

FIG. 19A illustrates an additional embodiment as utilized as a neck shawl or scarf. Panel portion 400 is centered around the shoulders and the neck in even proportions on each side. The panel portion 400, tube portions 200, 300, and body portion 100 can be tied or twisted in front to create a variety of looks and shawls.

Figure 19B:
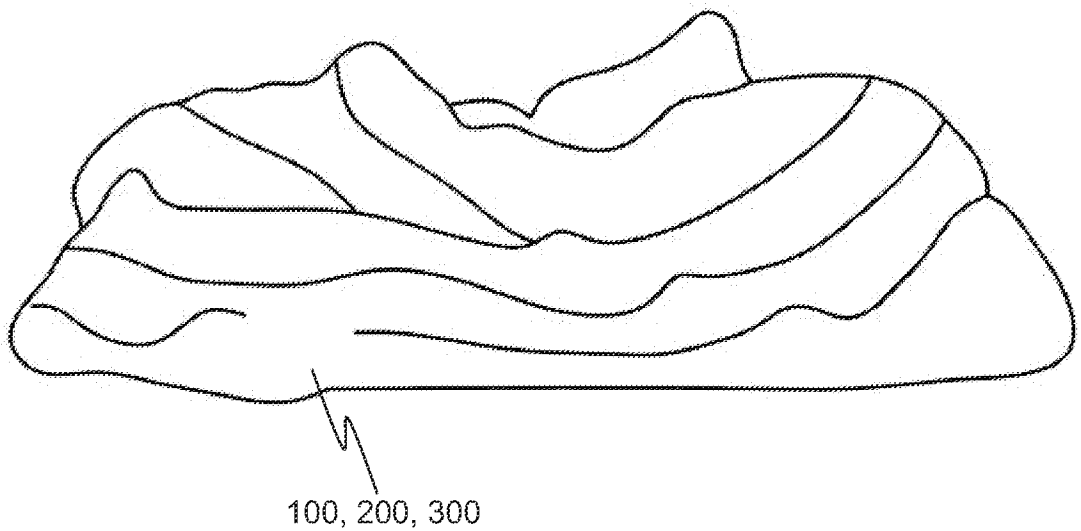
FIG. 19B is a rear view of the embodiment in FIG. 19A.

FIG. 19B Illustrates the back view of FIG. 19A.

As illustrated in FIGS. 20 A and 20 B, and in another embodiment, the garment 10 can be worn as the gaucho wrap pants. Legs are placed into tube portions 200, 300 with the garment's opening towards the front. The body portion 100 is pulled up to the middle of the abdominal waist area to secure that the front and hip area is covered. Additionally, this is further achieved by pulling the first flap 82 of panel portion 400 across the hip and waist area and around the top of body portion 100. Thereafter, one would also pull the second flat 84 of panel portion 400 across the other side, overlapping body portion 100 and the other flap 82 of panel portion 400. To secure said garment into place for a comfortable fitting pant garment and tie it in place a knot can be tied in the front or in the back.

Figure 20A:
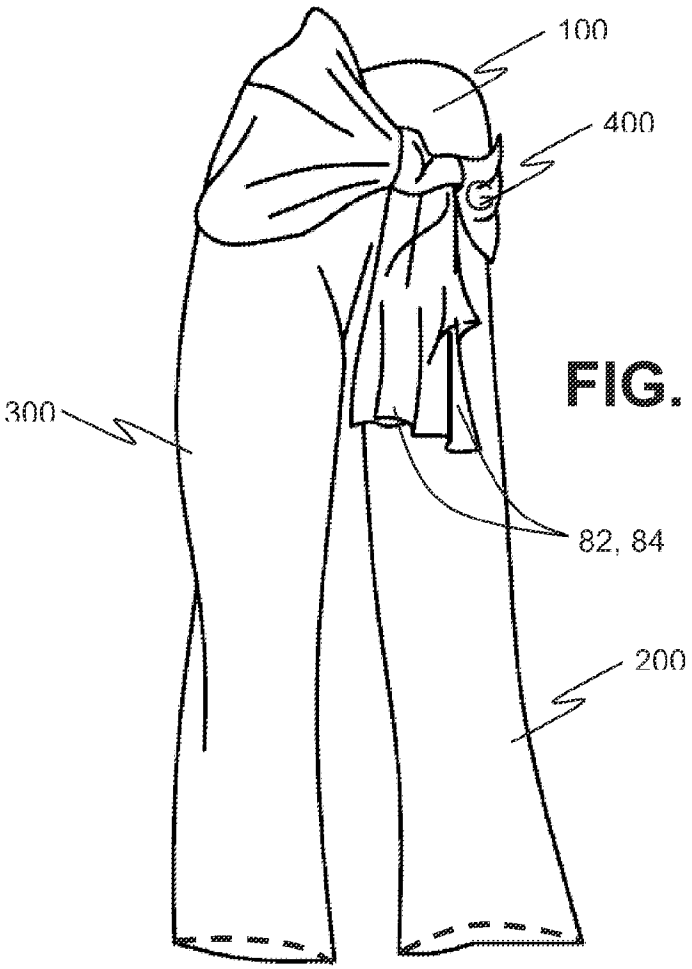
FIG. 20A is a front view of another embodiment of the convertible garment which is worn as a gaucho wrap pants wherein the garment opens toward the front, the tubes are worn as pants' legs and the panel is around the hip and waste area.
Figure 20B:
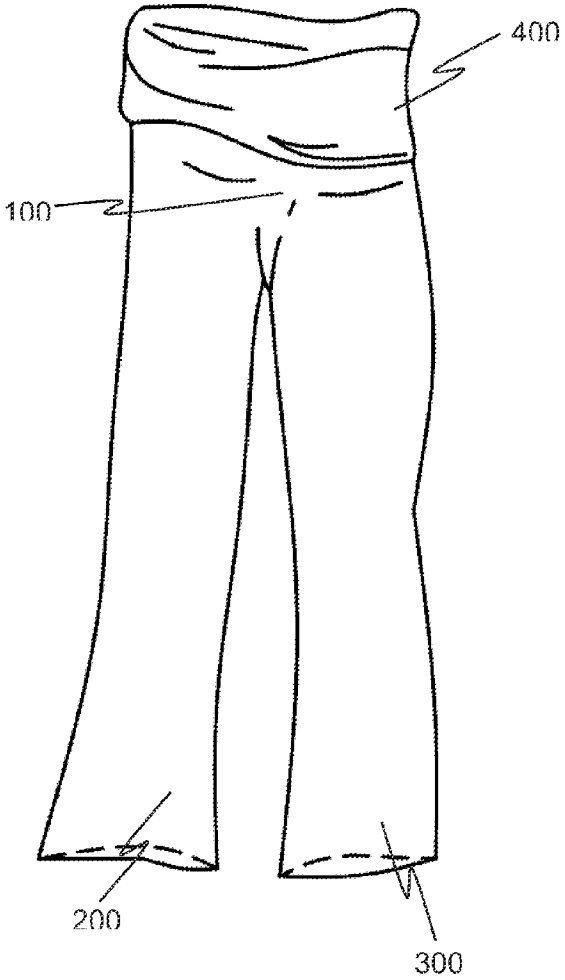
FIG. 20B is a rear view of the embodiment in FIG. 20A.

FIG. 20A is a front view and FIG. 20B is a back view of the garment worn as the gaucho wrap pants.

The figures do not limit the possibilities of the garment as any variations of these functionalities can be modified to taste to create even more styles.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A convertible garment adapted to be worn in various styles comprising:

a body portion having an inner layer and an overlapping exterior layer of fabric of an equal size, each said layer having a first and second vertical edge, a first and second horizontal edge, both said layers are completely connected on the first horizontal edge leaving no opening along the first horizontal edge;

a first tube portion having a first layer and an overlapping second layer of fabric of an equal size, the first layer is connected to the first vertical edge of the inner layer of the body portion, the second layer is connected to the first vertical edge of the exterior layer of the body portion, both said layers of the first tube portion are connected together to form a tube shape with an opening on one end;

a second tube portion having a first layer and an overlapping second layer of fabric of an equal size, the first layer is connected to the second vertical edge of the inner layer of the body portion, the second layer is connected to the second vertical edge of the exterior layer of the body portion, both said layers of the second tube portion are connected together to form a tube shape with an opening on one end; and a panel portion being generally rectangular in shape having two free vertical edges, a first horizontal edge of which only the middle region is connected to the second horizontal edge of the exterior layer of the body portion, and a second horizontal edge which is not connected to any other portion of the garment;

wherein the panel portion is not connected to the second horizontal edge of the inner layer of the body portion leaving the second horizontal edges of both said layers of the body portion separate from each other to form an opening between the exterior layer and inner layer for a person to extend his/her hands or legs into the tube portions and out of the tubes' openings; wherein the body portion and both the first and second tubes are sizably dimensioned to allow a person to wear the garment on the upper body with the two tubes being worn as arm sleeves and both inner and exterior layers stay together covering a wearer's upper back or covering the wearer's chest or on the lower body with the two tubes being worn as pants' legs and the body portion covering the wearer's pelvic area.

2. The convertible garment of claim 1, wherein the tube portions are capable of being made in various shapes including one of tapered shape, wide bell shape or straight shape.

3. The convertible garment of claim 1, wherein the garment is made of one sheet of generally rectangular light weight directional stretchable fabric having an inner surface, an outer surface, two horizontal edges, and two vertical edges.

4. The convertible garment of claim 3, wherein the sheet of fabric is selected from the group of stretch polyester fleece, jersey knit, polyester/cotton, and any combinations thereof.

5. The convertible garment of claim 3, wherein the sheet of fabric is dimensioned such that a dimension measured between the two vertical edges is greater than a dimension measured between the two horizontal edges.

6. The convertible garment of claim 5, wherein the dimension measured between the two vertical edges is about 60 inches and the dimension measured between the two horizontal edges is about 50 inches.

7. The convertible garment of claim 5, wherein the sheet of fabric is stretchable between the two vertical edges and not stretchable between its horizontal edges.

8. The convertible garment of claim 1, wherein the body portion is worn on one's back, the two tubes are worn as arm sleeves, the panel is up around ones neckline and worn as a shawl, scarf, cowl neck collar or wrap when the garment is worn on the upper body in a way that the panel is on the top of the garment and the body portion is on the bottom of the garment.

9. The convertible garment of claim 1, wherein the body portion is worn on one's back, the two tubes are worn as arm sleeves, the panel is around one's hip level when the garment is worn on the upper body in a way that the body portion is on the top of the garment and the panel is on the bottom of the garment.

10. The convertible garment of claim 1, wherein the body portion is worn on one's front, the two tubes are worn as arm sleeves, the panel is draping around one's hip level when the garment is worn on the upper body in a way that the body portion is on the top of the garment and the panel is on the bottom of the garment.

11. The convertible garment of claim 1, wherein the garment can be worn as a turban, a head dress, a neck shawl or scarf.

12. The convertible garment of claim 1, wherein the two tubes are worn as pants' legs, the panel is around ones hip and waist when the garment is worn as gaucho wrap pants.

13. The convertible garment of claim 1, wherein the body portion, panel portion, and tube portions are capable of being produced in various sizes.

* * * * *